US005726696A

United States Patent [19]

Saito et al.

[11] Patent Number: 5,726,696

[45] Date of Patent: Mar. 10, 1998

[54] INK JET RECORDING HEAD HAVING RESERVE FUNCTIONAL DEVICES

[75] Inventors: Asao Saito, Yokohama; Hiroyuki Ishinaga, Tokyo; Teruo Ozaki, Kawasaki; Ryoichi Koizumi, Yokohama, all of Japan

[73] Assignee: Canon Kabushiki Kaisha, Tokyo, Japan

[21] Appl. No.: 819,072

[22] Filed: Mar. 18, 1997

Related U.S. Application Data

[63] Continuation of Ser. No. 538,034, Oct. 2, 1995, abandoned, which is a continuation of Ser. No. 101,531, Dec. 23, 1992, abandoned, which is a continuation of Ser. No. 644,561, Jan. 23, 1991, abandoned.

[30] Foreign Application Priority Data

Jan. 25, 1990 [JP] Japan ..... 2-013487
Jan. 25, 1990 [JP] Japan ..... 2-013488

[51] Int. Cl.[6] ..... B41J 2/05
[52] U.S. Cl. ..... 347/59; 257/48
[58] Field of Search ..... 347/59, 58, 19; 257/48, 775

[56] References Cited

U.S. PATENT DOCUMENTS

| | | | |
|---|---|---|---|
| 4,197,632 | 4/1980 | Aomura | 437/8 |
| 4,313,124 | 1/1982 | Hara . | |
| 4,313,684 | 2/1982 | Tazaki | 347/37 |
| 4,345,262 | 8/1982 | Shirato et al. . | |
| 4,429,321 | 1/1984 | Matsumoto | 347/59 |
| 4,459,600 | 7/1984 | Sato et al. . | |
| 4,463,359 | 7/1984 | Ayata et al. . | |
| 4,558,333 | 12/1985 | Sugitani et al. . | |
| 4,633,274 | 12/1986 | Matsuda . | |
| 4,635,080 | 1/1987 | Watanabe . | |
| 4,723,129 | 2/1988 | Endo et al. | 347/56 |
| 4,740,796 | 4/1988 | Endo et al. | 347/56 |
| 4,751,458 | 6/1988 | Elward | 324/158 F |
| 4,971,921 | 11/1990 | Fukunaga | 437/7 X |
| 4,980,702 | 12/1990 | Kneezel | 346/17 |
| 5,036,337 | 7/1991 | Rezanka | 347/67 X |
| 5,216,447 | 6/1993 | Fujita | 347/59 |

FOREIGN PATENT DOCUMENTS

| | | | |
|---|---|---|---|
| 0223412 | 5/1987 | European Pat. Off. | B41J 3/04 |
| 0340533 | 11/1989 | European Pat. Off. . | |
| 0378439 | 7/1990 | European Pat. Off. | B41J 2/05 |
| 0401440 | 12/1990 | European Pat. Off. | B41J 2/05 |
| 3511699 | 10/1985 | Germany | B41J 3/04 |
| 54-56847 | 5/1979 | Japan | B41J 2/26 |
| 57-72867 | 5/1982 | Japan | B41J 3/04 |
| 59-123670 | 7/1984 | Japan | B41J 3/04 |
| 59-138461 | 8/1984 | Japan | B41J 3/04 |
| 60-71260 | 4/1985 | Japan | B41J 3/04 |

*Primary Examiner*—Joseph W. Hartary
*Attorney, Agent, or Firm*—Fitzpatrick, Cella, Harper & Scinto

[57] ABSTRACT

An ink jet recording apparatus comprises a liquid ejection portion having an ejection outlet for ejecting ink; and a recording head having a substrate on which are provided an electrothermal transducer for generating heat for the ejection of ink supplied to the ejection portion, at least one functional device electrically connected to the electrothermal transducer, and a laminate. The structure of at least a part of the laminate is identical with the structure of the functional devices and the laminate is useable as a reserve functional device. Such construction of the recording head makes it possible to change the function thereof easily, and, can be copied flexibly with change of design. A portion of the functional device can be formed in a U shape.

10 Claims, 21 Drawing Sheets

INK JET RECORDING HEAD HAVING RESERVE FUNCTIONAL DEVICES

This application is a continuation of application Ser. No. 08/538,034, filed Oct. 2, 1995, which was a continuation of application Ser. No. 08/101,532, filed Dec. 23, 1992, which was a continuation of application Ser. No. 07/644,561, filed Jan. 23 1991, all now abandoned.

BACKGROUND OF THE INVENTION

1. Field of the Invention

The present invention relates to ink jet recording apparatuses, recording heads and substrates for the recording heads used for copying machines, facsimiles, word processors, printers as output terminals for work stations, personal computers, host computers, optical disc apparatuses, video printers, etc. More specifically, the present invention relates to a recording head where electrothermal transducers which generate thermal energy used for energy to discharge or eject ink onto physical materials and recording functional devices are configurated on the common substrate, a substrate for the foregoing ink jet recording head and to an ink jet recording apparatus including the ink jet recording head.

2. Related Background Art

Conventionally, in general, this type of recording heads has the following structures. Electrothermal transducers are arranged in an array geometry and formed on a single crystal silicon substrate. A drive circuit for these electrothermal transducers is formed outside the silicon substrate by arranging functional devices such as transistor arrays and/or diode arrays in order to drive electrothermal transducers. Electric connections between electrothermal transducers and functional devices like transistors arrays were made by flexible cables and wire bonding.

On the other hand, with respect to the above mentioned recording head structures, for the purpose of simplification of its structures, reduction of the fraction of failed components arising during manufacturing processes, and furthermore, with an effort of attaining a uniformity of characteristics of electronic devices and an improvement of reproducibility in the manufacture of the high quality head was developed, developed was an ink jet recording head which has electrothermal transducers and functional devices, both of them formed on the common substrate, as disclosed in Japanese Patent Application Laying-Open No. 72867/1982. U.S. Pat. No. 4,429,321 has foreign priority based at least in part on the Japanese patent application from which the aforementioned Japanese document matured.

FIG. 1 shows a part of a recording head formed on the common substrate structure. The region 901 is a semiconductor substrate formed by a single crystal silicon. The region 902 is an N semiconductor collector region. The region 903 is an ohmic contact region of N semiconductor containing high level impurity concentration. The region 904 is a base region of P semiconductor. The region 905 is an emitter region of N semiconductor containing high level impurity concentration. The regions 902 to 905 form a by bipolar transistor 920. The region 906 is a silicon oxide layer as a heat accumulating and insulating layer. The region 907 is a hafnium boride ($HfB_2$) layer as a resistor layer for heating. The region 908 is an aluminium electrode. The region 909 is a silicon oxide layer as a protective layer. The regions 906 to 909 form a substrate 930 for a recording head. In the layers configuration of FIG. 1, the region 940 is a heating part. The top plate 910 is connected to the substrate 930 to form a fluid passage, which is connected to the ejection outlet 950A, in conjunction with the substrate 930.

However, in accordance with such prior art, there are such problems as it takes relatively long time in processes to build-in the functional devices and the electrothermal transducers on the silicon substrate.

Moreover, because the position of the functional device on the substrate is fixed in accordance with the use thereof, there are disadvantages that it is not easily possible to flexibly change the design of the substrate, and it sometimes causes waste of money spent etc.

Namely, a portion of the production process of the functional device, such as the production process of epitaxial layer, is sometimes placed in order to outside, and while placing in order, it is common to order a large amount number. Therefore, once the position of the functional device is determined, in order to change the position thereof later, the substrate which were already ordered and produced may be useless. Further, in the step of trial manufacture at the initiation of development, the process must be repeated from the first step every time when the position of the functional device is changed, therefore it may impede shortening the development period.

Further, on the silicon substrate of the above-mentioned recording head, a functional device for temperature control is often provided. But, since, when the position of the functional device is changed depending on the use of the recording head, another wafer which corresponds to the changing must be prepared, therefore, it sometimes hampers the common use of the parts.

Further, the shape of the electrodes of the semiconductor functional device is determined by its own restrictive conditions, namely, first, electric characteristics particularly required for the ink jet recording apparatus, such as current, voltage and so on, and second, a requirement in size for cost reducing of the device. Further, the shape of the electrodes is also designed for the purpose of connecting those devices to an external electric circuit or of protecting from destruction and damage due to external causes.

However, since the semiconductor device is easily damaged by dust in manufacture thereof, contact of probe to the device or test of the device, that can be a main cause of dust produced, is not normally carried on the way of process. Therefore, the outer shape of the electrodes is usually determined without taking into consideration for measurement of devices.

And, test of the electric characteristics of the semiconductor device is carried at the time when the formation of the device is completed. Namely, measurement is carried out by using wire connected to the electrodes formed on the surface of the device and pads provided for probing thereon. Therefore, in the formation process of the ink jet recording apparatus, which uses heat energy as the energy for recording, since the electrothermal transducers are formed after formation of the electrodes of semiconductor devices, measurement of the semiconductor devices per se cannot be performed if the electrodes are designed in the conventional manner. Namely, the characteristics of the semiconductor device before forming the electrothermal transducer cannot be known. Because of this, even if a deterioration in the characteristics occurs to the semiconductor device as the functional device it often cannot be found until the completion of formation of the electrothermal transducer, thereby sometimes decreasing production yield.

SUMMARY OF THE INVENTION

Accordingly, it is an object of the present invention to provide an ink jet recording apparatus which can easily accommodate design change.

It is another object of the present invention to improve the shape of the electrodes of the semiconductor devices on semiconductor substrate for use in a recording head, thereby increasing production yield of an ink jet recording head.

It is a further object of the present invention to provide a substrate for the ink jet recording head.

It is a still further object of the present invention to provide an ink jet recording apparatus using the above-mentioned recording head.

It is yet a further object of the present invention to provide a copying machine to which the ink jet recording system is equipped.

It is yet a further object of the present invention to provide a facsimile machine to which the ink jet recording system is equipped.

It is yet a further object of the present invention to provide a word processor to which the ink jet recording system is equipped.

It is yet a further object of the present invention to provide an optical disc apparatus to which the ink jet recording system is equipped.

It is yet a further object of the present invention to provide a work station to which the ink jet recording system is equipped.

It is yet a further object of the present invention to provide a personal or host computer to which the ink jet recording system is equipped.

It is yet a further object of the present invention to provide a portable or handy printer having the above-described recording head.

In the first aspect of the present invention, an ink jet recording head comprises:

an ink discharging portion having an outlet for discharging ink; and a substrate on which are provided an electrothermal transducer for generating thermal energy utilized for discharging ink supplied to the ink discharging portion, at least one functional device electrically connected to the electrothermal transducer, and a laminate member;

wherein at least a part of the laminate member has a structure identical with a structure of the at least one functional device.

Here, an electrode of at the least one functional device may have a portion formed in a predetermined shape and so sized that a probe pin can be received therein.

In the second aspect of the present invention, an ink jet recording head comprises:

an ink discharging portion having an outlet for discharging ink; and a substrate on which are provided an electrothermal transducer for generating thermal energy utilized for discharging ink supplied to the ink discharging portion, and at least one functional device electrically connected to the electrothermal transducer;

wherein electrodes of at the least one functional device are positioned below the electrothermal transducer, each of the electrodes has a portion formed in a predetermined shape and so sized that a probe pin can be received therein.

Here, the size of the predetermined shape may be not less than 40 μm in width and may be not less than 80 μm in length, and the portions of all the electrodes within the at least one functional device may be disposed in a same predetermined direction.

In the third aspect of the present invention, a substrate for an ink jet recording head comprises:

an electrothermal transducer for generating thermal energy utilized for discharging ink;

functional devices electrically connected to the electrothermal transducer; and a laminate member;

wherein at least a part of the laminate member has a structure substantially identical with a structure of the at least one functional device.

Here, the laminate member may be so disposed to accomplish the function for driving the electrothermal transducer or for detecting temperature of the recording head.

The laminate member may include at least a diffusion layer on the substrate.

In the fourth aspect of the present invention, a substrate for an ink jet recording head comprises:

an electrothermal transducer for generating a thermal energy to be utilized for discharging ink; and at least one functional device electrically connected to the electrothermal transducer;

wherein electrodes of the at least one functional device are positioned below the electrothermal transducer, each of the electrodes has a portion formed in a predetermined shape and so sized that a probe pin can be received therein.

Here, a substrate for an ink jet recording head further may comprise a laminate member including a structure substantially identical with a structure of at the least one functional device.

In the fifth aspect of the present invention, a method for manufacturing an ink jet recording head comprises the steps of:

forming a plurality of laminated structures including collector regions, base regions and emitter regions on a semiconductor substrate, respectively; and forming electrode metallic layers, excluding a part of the plurality of laminated structure, on the collector regions, the base regions and the emitter regions of the remaining portion of the substrate, respectively.

In the sixth aspect of the present invention, an ink jet recording apparatus comprises:

a recording head including an ink discharging portion having an outlet for discharging ink and a substrate on which are provided an electrothermal transducer for generating thermal energy utilized for discharging ink supplied to the ink discharging portion, at least one functional device electrically connected to the electrothermal transducer, and a laminate member, a structure of at least a part of which is substantially identical with a structure of the at least one functional device.

means for supplying the ink to the recording head; and means for transmitting a recording medium to the recording position by the recording head.

In the seventh aspect of the present invention, an ink jet recording apparatus comprises:

a recording head including an ink discharging portion having an outlet for discharging ink and a substrate on which are provided an electrothermal transducer for generating thermal energy utilized for discharging ink supplied to the ink discharging portion, and at least one functional device electrically connected to the electrothermal transducer, electrodes of the at least one functional device being positioned below the electrothermal transducer, each of the electrodes having a portion formed in a predetermined shape and so sized that a probe pin can be received therein;

means for supplying the ink to the recording head; and means for transmitting a recording medium to the recording position by the recording head.

In the eighth aspect of the present invention, a copying machine comprises:

an ink jet recording unit comprising:

a recording head including an ink discharging portion having an outlet for discharging ink and a substrate on which are provided an electrothermal transducer for generating thermal energy utilized for discharging ink supplied to the ink discharging portion, and at least one functional device electrically connected to the electrothermal transducer, electrodes of the at least one functional device being positioned below the electrothermal transducer, each of the electrodes having a portion formed in a predetermined shape and so sized that a probe pin can be received therein;

means for supplying the ink to the recording head; and means for transmitting a recording medium to the recording position by the recording head.

In the ninth aspect of the present invention, a facsimile machine comprises:

an ink jet recording unit comprising:

a recording head including an ink discharging portion having an outlet for discharging ink and a substrate on which are provided an electrothermal transducer for generating thermal energy utilized for discharging ink supplied to the ink discharging portion, and at least one functional device electrically connected to the electrothermal transducer, electrodes of the at least one functional device being positioned below the electrothermal transducer, each of the electrodes having a portion formed in a predetermined shape and so sized that a probe pin can be received therein;

means for supplying the ink to the recording head; and means for transmitting a recording medium to the recording position by the recording head.

In the tenth aspect of the present invention, a word processor comprises:

an ink jet recording unit comprising:

a recording head including an ink discharging portion having an outlet for discharging ink and a substrate on which are provided an electrothermal transducer for generating thermal energy utilized for discharging ink supplied to the ink discharging portion, and at least one functional device electrically connected to the electrothermal transducer, electrodes of the at least one functional device being positioned below the electrothermal transducer, each of the electrodes having a portion formed in a predetermined shape and so sized that a probe pin can be received therein;

means for supplying the ink to the recording head; and means for transmitting a recording medium to the recording position by the recording head.

In the eleventh aspect of the present invention, an optical disc apparatus comprises:

an ink jet recording unit comprising:

a recording head including an ink discharging portion having an outlet for discharging ink and a substrate on which are provided an electrothermal transducer for generating thermal energy utilized for discharging ink supplied to the ink discharging portion, and at least one functional device electrically connected to the electrothermal transducer, electrodes of the at least one functional device being positioned below the electrothermal transducer, each of the electrodes having a portion formed in a predetermined shape and so sized that a probe pin can be received therein;

means for supplying the ink to the recording head; and means for transmitting a recording medium to the recording position by the recording head.

In the twelfth aspect of the present invention, a work station comprises:

an ink jet recording unit comprising:

a recording head including an ink discharging portion having an outlet for discharging ink and a substrate on which are provided an electrothermal transducer for generating thermal energy utilized for discharging ink supplied to the ink discharging portion, and at least one functional device electrically connected to the electrothermal transducer, electrodes of the at least one functional device being positioned below the electrothermal transducer, each of the electrodes having a portion formed in a predetermined shape and so sized that a probe pin can be received therein;

means for supplying the ink to the recording head; and means for transmitting a recording medium to the recording position by the recording head.

In the thirteenth aspect of the present invention, a computer comprises:

an ink jet recording unit comprising:

a recording head including an ink discharging portion having an outlet for discharging ink and a substrate on which are provided an electrothermal transducer for generating thermal energy utilized for discharging ink supplied to the ink discharging portion, and at least one functional device electrically connected to the electrothermal transducer, electrodes of the at least one functional device being positioned below the electrothermal transducer, each of the electrodes having a portion formed in a predetermined shape and so sized that a probe pin can be received therein;

means for supplying the ink to the recording head; and means for transmitting a recording medium to the recording position by the recording head.

In the fourteenth aspect of the present invention, a portable printer comprises:

an ink jet recording unit comprising:

a recording head including an ink discharging portion having an outlet for discharging ink and a substrate on which are provided an electrothermal transducer for generating thermal energy utilized for discharging ink supplied to the ink discharging portion, and at least one functional device electrically connected to the electrothermal transducer, electrodes of the at least one functional device being positioned below the electrothermal transducer, each of the electrodes having a portion formed in a predetermined shape and so sized that a probe pin can be received therein;

means for supplying the ink to the recording head; and means for transmitting a recording medium to the recording position by the recording head.

According to the above-described construction of the present invention, in addition to the functional device provided for the main purpose thereof, a part of the structure of the functional device is disposed as a reserve on the substrate, therefore, it is possible to change functions easily, to shorten the development period, and/or to avoid the waste resulted from changing the design on the way of production.

Further, measurement of the characteristics of the functional devices is possible in the step before formation of the wiring on upper layer and the electrothermal transducers. Namely, the test step of the functional device can be positioned before the step for forming the electrothermal transducer, thereby can increase production yield of the recording head. According to this, highly accurate measurement can be performed without forming a monitor device as the measurement in the conventional semiconductor production process. On the contrary, the monitor device can be replaced by another device in the space thereof.

Furthermore, if all the electrodes of the functional device line up in one direction and are bigger than predetermined size in width and length, and the ratio of length to breadth of the functional device are determined appropriately in considering current-carrying capacity and probing ability thereof, it enables designing without waste, miniaturization and reduction of production cost, and thus provide an inexpensive ink jet recording apparatus.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Hereinafter, the detail of the present invention will be explained with reference to drawings, but, it should be noted that the present invention would not be limited to the embodiments below but includes alternatives, modifications and/or variations which can achieve the purposes of the present invention.

Figure 1:
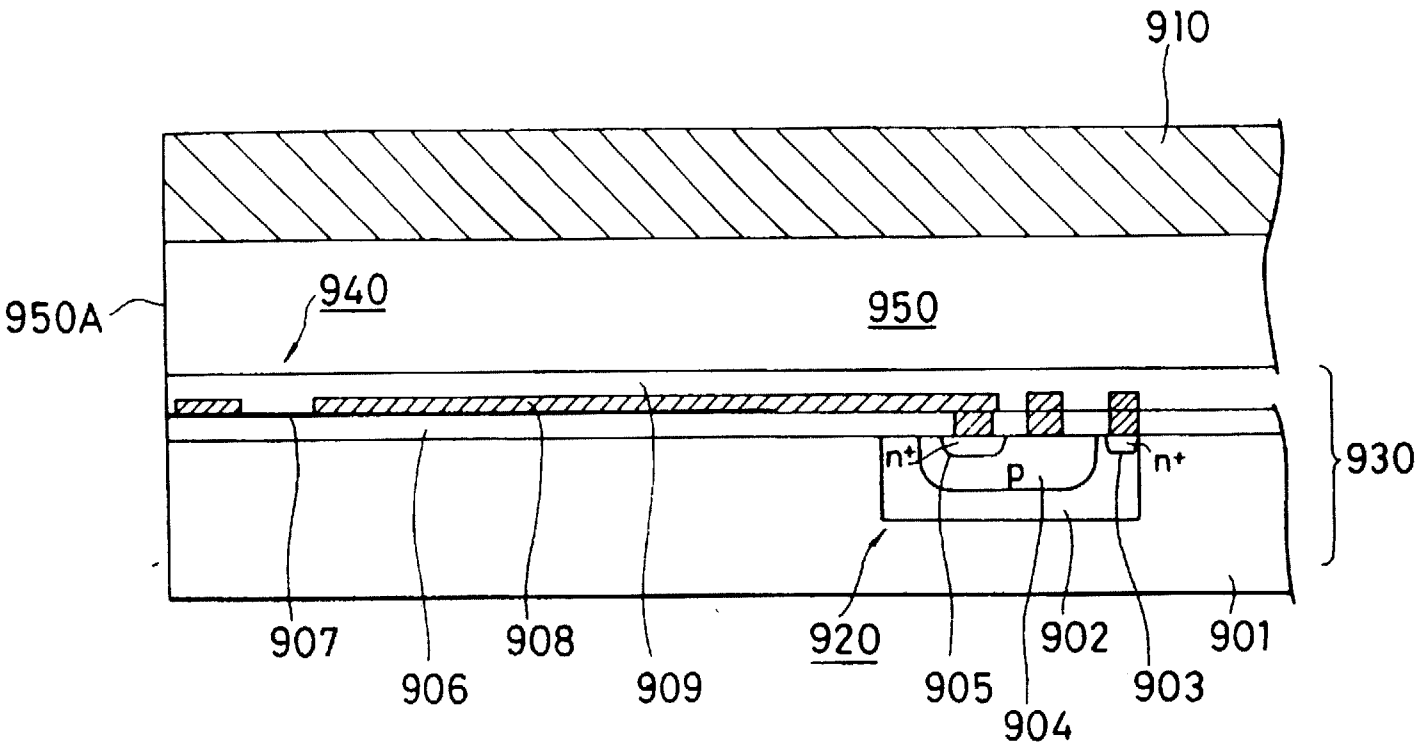
FIG. 1 PRIOR ART
FIG. 1 is a schematic sectional view showing a part of the conventional recording head.
Figure 2A:
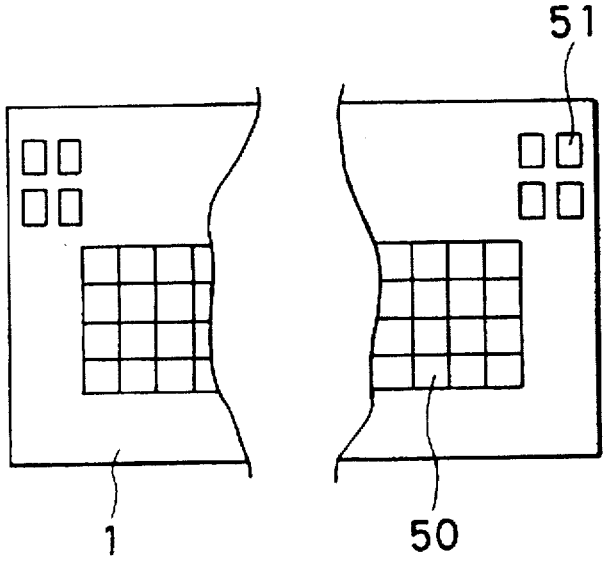
FIGS. 2A and 2B are a schematic top plan view showing an embodiment of a substrate for use in a recording head according to the present invention and a sectional view schematically showing the wiring part thereof, respectively.

FIG. 2A is a schematic plan view of a substrate for an ink jet recording head as a first embodiment of the present invention. In the substrate diodes are used as the functional devices.

Here, temperature sensor diodes 51 are disposed on a substrate plate or a silicon substrate as well as driving diodes 50 disposed in the array. The whole constructions of the driving diodes 50 are built-in on the silicon substrate 1, but only the diffusion layer, formed in diffusion process, of the temperature sensor diodes are built-in on the silicon substrate 1. The reason of providing the temperature sensor is as follows.

In a recording head of liquid ejection type, recording is achieved by discharging or ejecting liquid such as ink by using heat energy with electrothermal transducer. Since a part of heat energy generated is stored in the liquid when actuating such recording head, the temperature at the recording head may increase gradually following the operation of recording.

This increase of the temperature gives effects to the viscosity of the ink, process of bubble growing, and amount of ink ejected therefrom, the diameter of a dot recorded on the recording medium on which letters or pictures to be recorded is varied. This is not a preferable phenomenon, since this results in deterioration of picture quality recorded on the recording medium. For solving this problem, detection of the temperature of the recording head and controlling the temperature to decrease depending on the detected temperature are conducted, for example stopping the recording operation and controlling temperature using such as a Peltier device.

As a measuring device for detecting the temperature at the recording head described above, a temperature detecting device formed on the substrate provided with heat-generating resistor is known. As a temperature detecting method the usage of a diode is proposed by which the temperature is detected in use of the temperature dependence of the forward voltage $V_F$ of the diode. Here, it is conceivable that the arrangement of the temperature sensor is varied depending on the construction and the manner of the usage of a detection system including the temperature sensor. For example, so as to obtain large output from the temperature sensor thereby aiming to reduce mixed noise in an amplifier circuit in a main control apparatus, it is conceivable to connect a plurality of diodes in series thereby increasing the output therefrom. Alternatively, to increase capacity of detecting temperature, relative relationship between the positions of the electrothermal transducer and the temperature sensor should be considered.

Therefore, as shown in FIG. 2A, when a plurality of diodes for use of temperature detection are in advance disposed at the positions where they may be used as the temperature sensor, it becomes easy to change the design thereof as described previously.

Next, the explanation about the connection of the diodes as the electrothermal transducer and as the functional device for driving the transducer, and about the driving of the electrothermal transducer will be given.

Figure 2B:
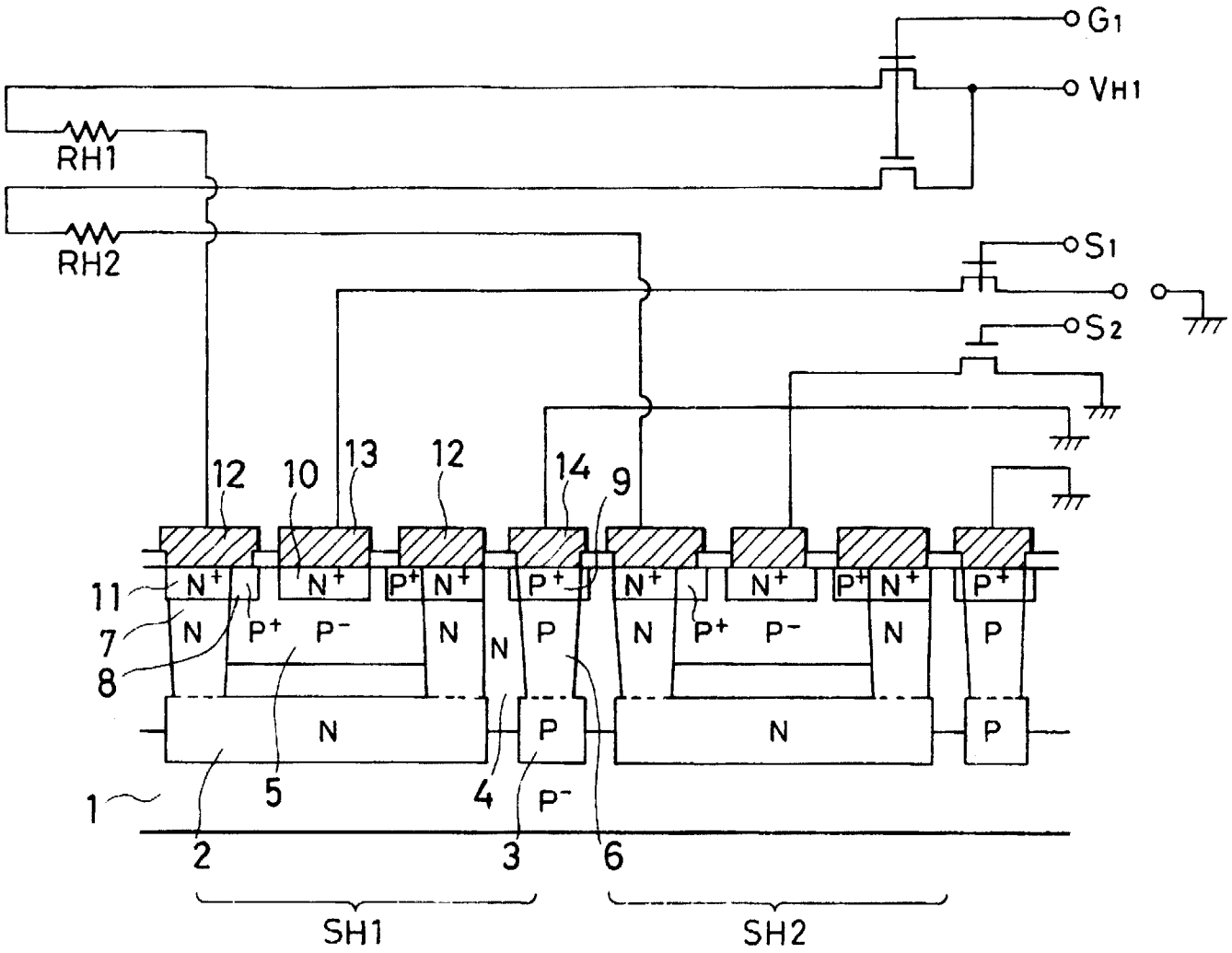

FIG. 2B is a sectional view schematically showing the wiring part of the substrate of this embodiment.

In the drawing, reference numeral 1 denotes the P-type silicon substrate, reference numeral 2 the N-type collector buried region for forming the functional device, reference numeral 3 the P-type isolation buried region for isolation of the functional device, reference numeral 4 the N-type epitaxial region, reference numeral 5 the P-type base region for forming the functional device, reference numeral 6 the P-type isolation region for isolation of device, reference numeral 7 the N-type collector region for forming the functional device, reference numeral 8 the high concentration P-type base region for forming the device, reference numeral 9 the high concentration P-type isolation region for isolation of the device, reference numeral 10 the N-type emitter region for forming the device, reference numeral 11 the high concentration N-type collector region for forming the device, reference numeral 12 the collector/base common electrode, reference numeral 13 the emitter electrode and reference numeral 14 the isolation electrode. Here, the NPN transistors SH1 and SH2 are formed, and the collector regions 2, 7 and 11 are formed in such manner that they completely surround the emitter region 10 and the base regions 5 and 8. And, each cell is enclosed by the P-type isolation buried region 3, the P-type isolation region 6 and the high concentration P-type isolation region 9 as the region for isolation of the devices to be electrically separated from one other.

The transistors SH1 and SH2 might be understood as diode cells composed of transistors, respectively, a common collector/base electrode 12 corresponds to an anode of the diode, and the emitter electrode 13 corresponds to a cathode of the diode. When driving the electrothermal transducers (RH1, RH2), an NPN transistor in a cell turns on due to applying a bias ($V_{H1}$) of positive potential to the electrothermal transducer connected to the common collector/base electrode 12, then, bias current flows out from the emitter electrode 13 as collector current and base current.

As the result of short-circuiting construction between the base and the collector, rise-up and cut-down characteristics of heat by the electrothermal transducer is improved, and occurrence of film boiling phenomenon and the resultant growing and shrinking of the bubble can be well controlled, thus, obtaining stable discharge of ink. It is thought that, the characteristics of the filmboiling are strongly related to the characteristics of the transistor in the ink jet recording head and since the storage of minority carriers in the transistor is small the switching characteristics the transistor is rapid, so that rise-up characteristics of the electrothermal transducer is unexceptedly improved. Further, parasitic effect is relatively small and a scattering in the characteristics of the devices is small, thereby the devices can be drived with a stable current. In this embodiment, furthermore, it has such construction that, by short-circuiting an isolation electrode 14 to ground, electric charge can be prevented from flowing into other cells in the vicinity thereof, and a malfunction of the other elements can be avoided.

In such semiconductor devices, it is preferable to have the impurity concentration in the N-type collector buried region more than $1\times10^{19}$ $cm^{-3}$, and to have the impurity concentration in the base region from $5\times10^{14}$ to $5\times10^{7}$ $cm^{-3}$, further, to have an area of junction region between the high concentration P-type base region and the electrode as small as possible. By doing so, occurrence of leakage current flowing from the NPN transistor to the ground through the P-type silicon substrate 1 and the isolation region can be avoided.

The driving method for the above recording head will be explained more detail. In FIG. 2B, there are shown only two semiconductor functional devices (cell), but, in actual product, for example, 128 electrothermal transducers corresponding to the number of functional devices are disposed and electrically connected in matrix to drive them in blocks.

Hereinafter, the explanation about driving of the electrothermal transducers RH1 and RH2 as two segments in the same group will be given.

In order to drive the electrothermal transducer RH1, first, the electrothermal transducer RH1 is selected to be applied with positive voltage $V_{H1}$ by a switch S1 as well as being selected by a switch G1. Then, the diode cell SH1 of transistor construction is positively biased and current flows out from the emitter electrode 13. Thereby, the electrothermal transducer RH1 generates heat which causes changing state of liquid to generate bubbles, and make the head to eject liquid from the ejection outlet.

In the same manner, when driving the electrothermal transducer RH2, the switch G1 and switch S2 are selectively turned on to actuate the diode cell SH2 and to supply current to the electrothermal transducer.

Figure 2C:
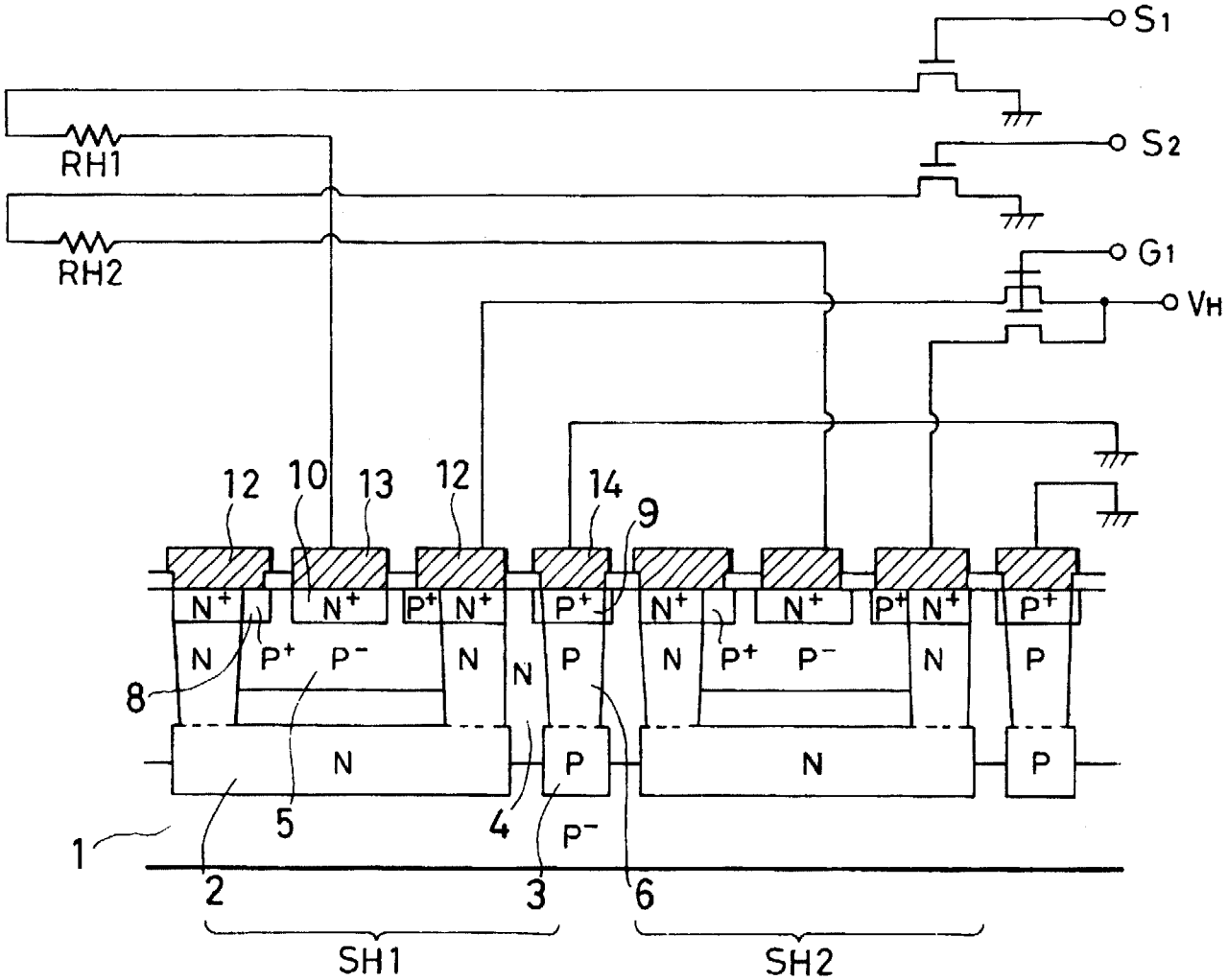
FIG. 2C is a sectional view schematically showing the wiring part of a substrate of another embodiment according to the present invention.

At this time, the silicon substrate 1 is grounded through the isolation regions 3, 6 and 9. By grounding the isolation regions 3, 6 and 9 of each of cells in this manner, malfunction due to electric interferences between each cells can be prohibited. Further, such construction as shown in FIG. 2C can be applied for the wiring portion. Namely, in FIG. 2C, positive bias voltage $V_{H1}$ is applied to the common collector/base electrode 12, then current flows from the emitter electrode 13 to the electrothermal transducer RH1 or RH2.

Figure 3A:
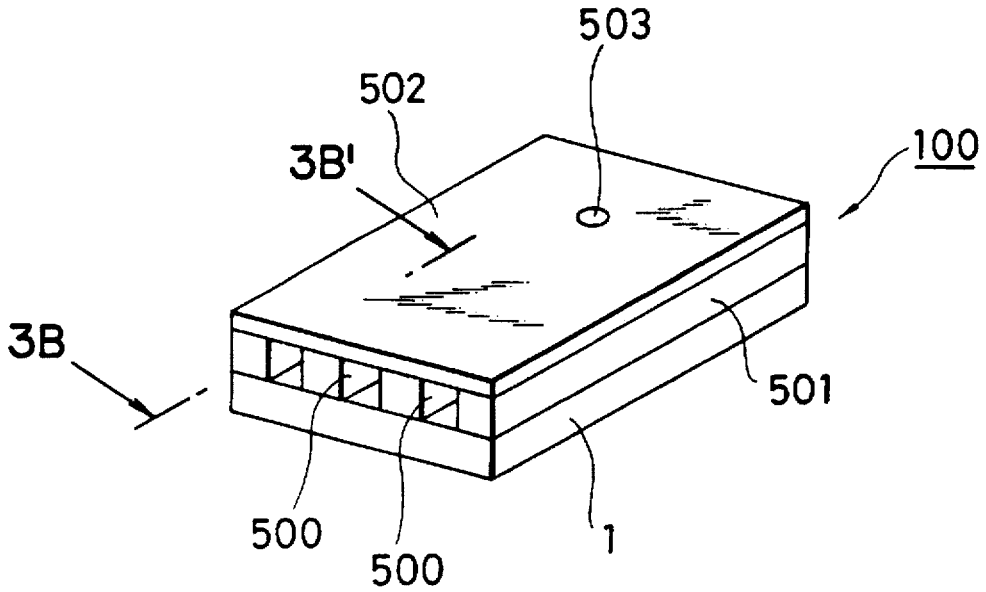
FIGS. 3A, 3B and 3C are a perspective view of a recording head of another embodiment according to the present invention, a sectional view as viewed at a line 3B–3B' thereof, and a schematic sectional view of a part of a diode in reserve, respectively.

FIG. 3A is a schematic perspective view showing the recording head constructed in the manner as described above. Such head as shown in the drawing has a plurality of ejection outlets 500, separation walls 501 made of photosensitive resin for defining liquid passages and communicating to the ejection outlets, top plate 502 and an ink supply inlet 503. Further, the separation walls 501 and the top plate 502 can be formed as a unit by forming with resin mold material.

Next, the substrate and the wiring part thereof will be explained in more detail.

Figure 3B:
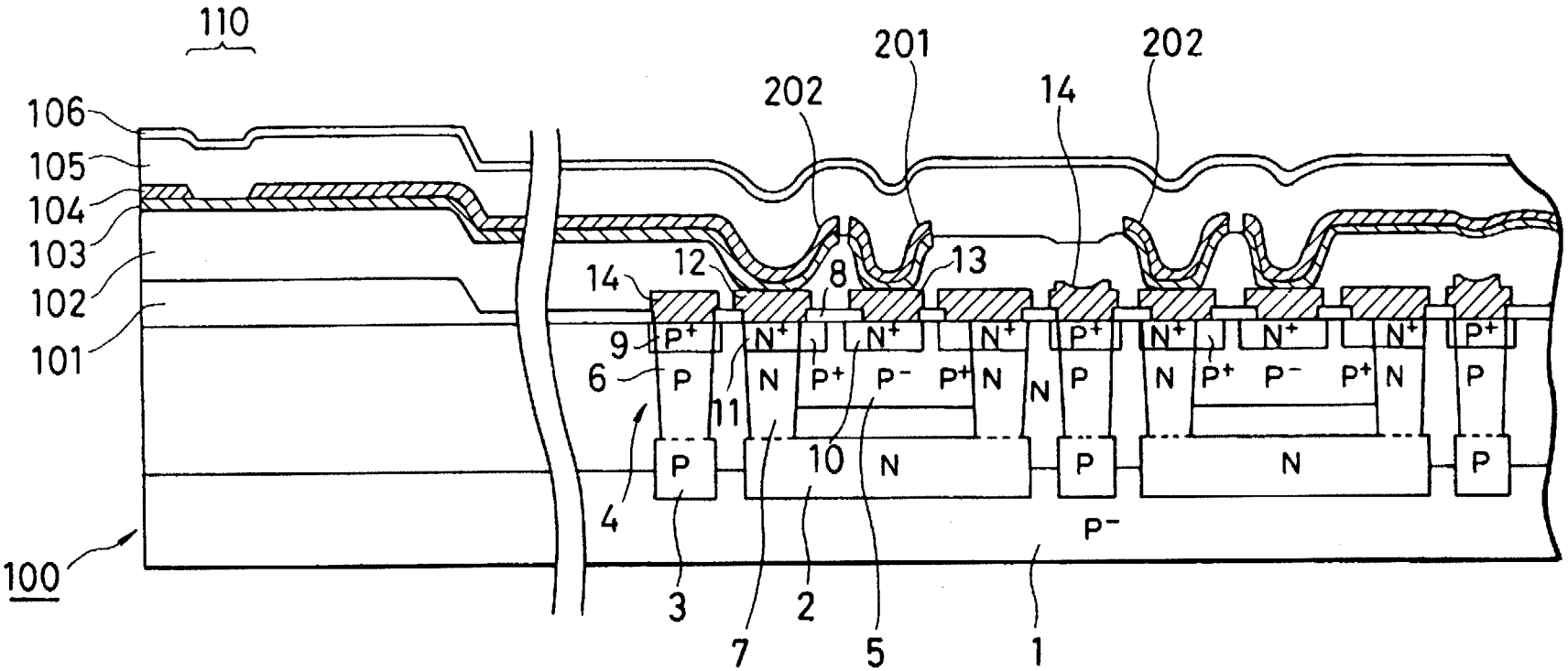

FIG. 3B is a schematic sectional view of the substrate for use in the recording head of the construction shown in FIG. 2B, and the wiring part thereof, i.e. the section by line 3B–3B' in FIG. 3A. In FIGS. 2B, 2C, 3B and 3C the same parts are designated with the same reference numerals. In a part of the substrate, as is shown by the schematic sectional view in FIG. 3C, the diodes in reserve are built-in.

Because the diodes in reserve are not yet in use, Al electrode for output and A1 wirings 201 and 202 for the anode and the cathode are not yet provided.

In the recording head 100 of this embodiment, a layer 101 of $SiO_2$ by thermal oxidization is formed on the substrate having the above-mentioned driving part. The electrothermal transducer 110 is composed of a thermal storage layer 102 of oxidized silicon by CVD method or sputtering method, a heat generating resistor layer 103 of $HfB_2$ and so on by sputtering method and an electrode 104 of A1 provided on the $SiO_2$ layer 101. The heat generating resistor layer 103 of the $HfB_2$ and so on is also provided between the collector/base common electrode 12 and the A1 wiring 202 and between the emitter electrode 13 and the A1 wiring 201.

Other than the above, the heat generating resistor layer may be made of Pt, Ta, $ZrB_2$, Ti—W, Ni—Cr, Ta—Al, Ta—Si, Ta—Mo, Ta—W, Ta—Cu, Ta—Ni, Ta—Ni—Al, Ta—Mo—Ni, Ta—W—Ni, Ta—Si—Al, Ta—W—Al—Ni, Ti—Si, W, Ti, Ti—N, Mo, Mo—Si, W—Si and so on. Moreover, a protection layer 105 of $SiO_2$ and so on and protection layer 106 of Ta and so on are formed by the sputtering method or CVD method on the heat generating part of the electrothermal transducer 110.

Here, the $SiO_2$ layer forming the heat storage layer 102 is formed as integrated with the interlayer insulation film formed between the lowest wirings 12 and 14 and the intermediate wirings 201 and 202.

Next, with reference to FIGS. 4A to 4K, the manufacturing process of the recording head of the embodiment will be explained.

(1) P-type of silicon oxide film of thickness about 5,000 to 20,000 Å was formed on the surface of the P-type silicon substrate 1 with impurity concentration of around $1\times10^{12}$ to $10^{16}$ $cm^{-3}$.

The silicon oxide film was partly removed where the collector buried region 2 for each cell is to be formed by photorithography process. Impurities of N-type, such as P or As were ion-implanted and the N-type collector buried region 2 with impurity concentration more than $1\times10^{19}$ $cm^{-3}$ was formed by thermal diffusion in depth of 10 to 20 μm. The sheet resistance of the N-type collector buried region thus formed was lower than 30Ω/□.

Figure 4A:
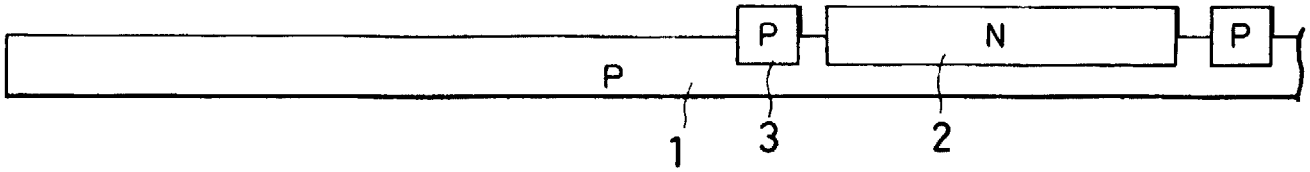
FIGS. 4A to 4K are schematic sectional views explaining an embodiment of a manufacturing process according to the present invention.

Subsequently, after removing the silicon oxide film where the P-type isolation buried region 3 should be formed and after forming the silicon film of about 100 to 3,000 Å in thickness, ion-implantation of impurity of P-type, such as B etc. was carried to form the P-type isolation buried region of impurity concentration of $1\times10^{17}$ to $10^{19}$ $cm^{-3}$ (FIG. 4A).

Figure 4B:
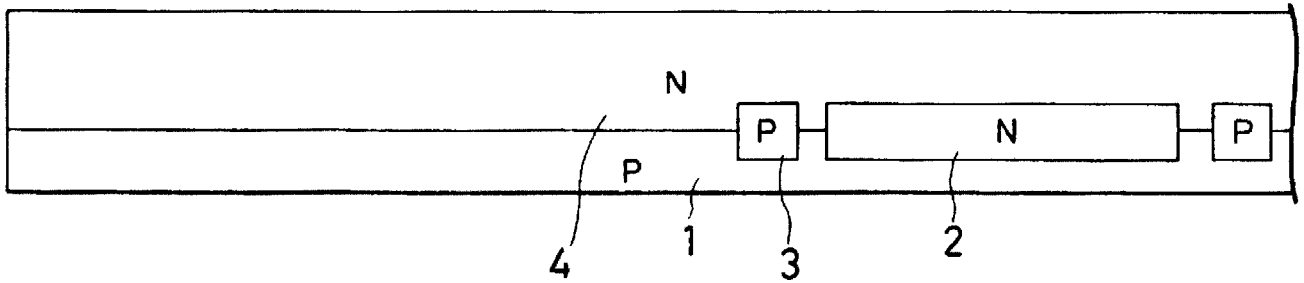

(2) After removing the silicon oxide film on whole surface, the N-type epitaxial region of impurity concentration about $1\times10^{12}$ to $10^{16}$ $cm^{-3}$ was epitaxially grown in thickness to about 5 to 20 μm (FIG. 4B).

(3) Next, silicon oxide film of about 100 to 300 Å thickness was formed on the surface of the N-type epitaxial region and a resist was applied thereon, and the oxide film was patterned, then, the impurity of P-type was ion-implanted only onto the region where the base region 5 of low concentration should be formed. After removing the resist, the P-type base region of low concentration of $5\times10^{14}$ to $5\times10^{17}$ $cm^{-3}$ was formed in depth of 5 to 10 μm by thermal diffusion.

Figure 4C:
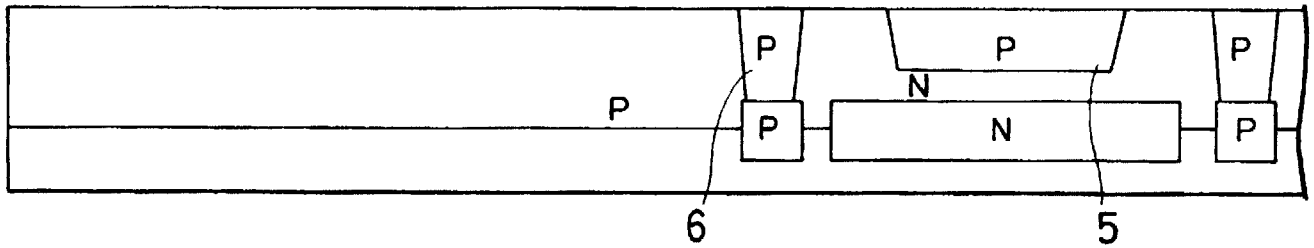

Again, after removing the silicon oxide film on the whole surface and further after forming the silicon oxide film of 1,000 to 10,000 Å thickness, the oxide film was removed from the region where the P-type isolation region 6 should be formed and borosilicate glass (BSG) film was deposited on the whole surface by using the CVD method. Furthermore, the P-type isolation region 6 of impurity concentration $1\times10^{18}$ to $10^{20}$ $cm^{-3}$ was formed by the thermal diffusion in about 10 μm thickness to reach the P-type isolation buried region 3 (FIG. 4C).

Here, $BBr_3$ can be used as the diffusion source.

(4) After removing the BSG film, the silicon oxide film of about 1,000 to 10,000 Å in thickness was formed, furthermore, after removing the oxide film from only the region where the N-type collector region should be formed, then the N-type collector region 7 is formed to reach the collector buried region 5 by thermal diffusion of N type impurity such as phosfer or by ion implantation of $P^+$ ion and the thermal diffusion process.

The sheet resistance of thus formed N-type collector region was as low as less than /10Ω/□. Further, the thickness of the region 7 was about 10 μm and the impurity concentration thereof was $1\times10^{18}$ to $10^{20}$ $cm^{-3}$.

Figure 4D:
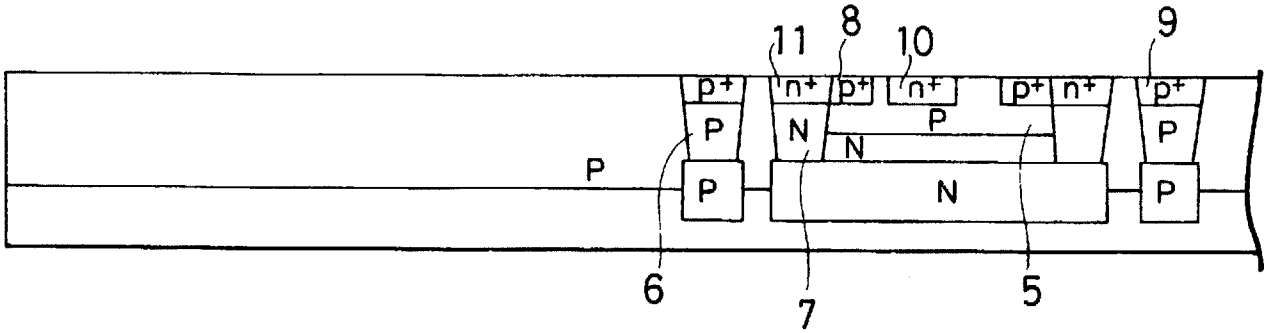

Subsequently, after removing the oxide film of the cell region, the silicon oxide film of 100 to 300 Å thickness was formed and patterned by using resist. Then, the ion-implantation of P-type impurity was carried out only onto the region where the high concentration base region 8 and the high concentration isolation region 9 should be formed. After removing the resist, the oxide film in the region where the N-type emitter region 10 and the high concentration N-type collector region 11 should be formed was removed. After forming the PSG film on the whole surface and implantation of $N^+$, the high concentration P-type isolation region 9, the N-type emitter region 10 and the high concentration collector region 11 were formed at the same time. The thickness of the region was less than 1.0 μm and the impurity concentration was $1\times10^{19}$ to $10^{20}$ $cm^{-3}$ (FIG. 4D).

Figure 3C:
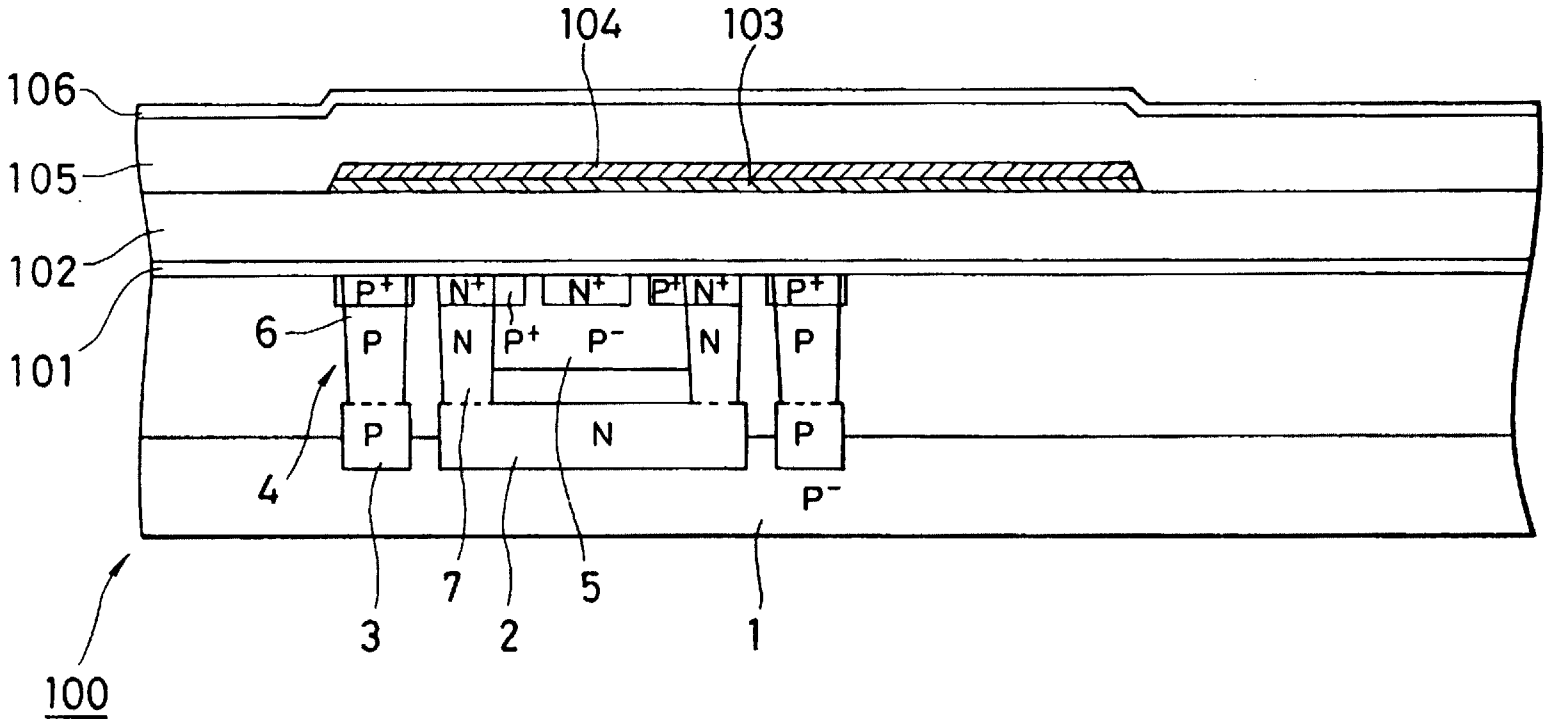

The processes described above are carried out to all the functional devices shown in FIG. 3B and the devices in reserve shown in FIG. 3C. However, the processes (5) to (8) which will be described below are not applied to the devices in reserve.

Figure 4E:
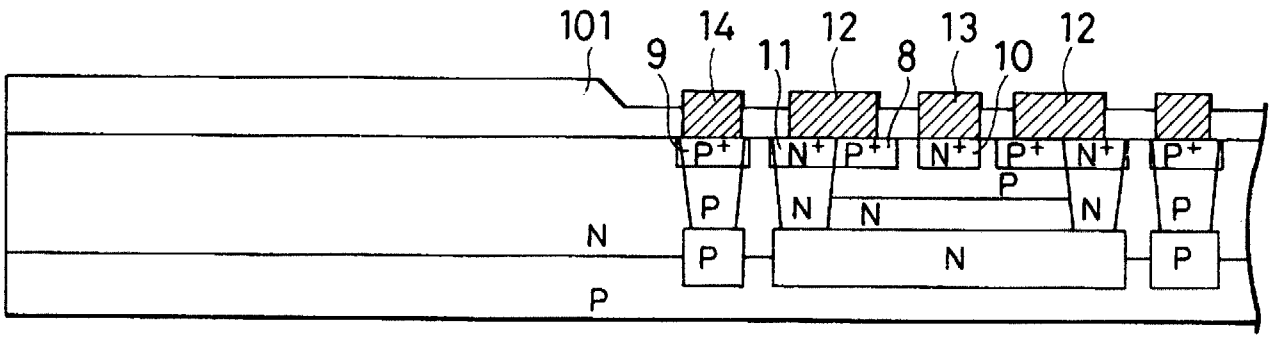

(5) After further forming the silicon oxide film 101, the silicon oxide layer at the region where the electrodes should be connected was removed. Then, film of A1 etc. was deposited on the whole surface, and a part of the A1 film deposited on the surface other than the electrode regions was removed to form the electrodes 12, 13 and 14 (FIG. 4E).

(6) Then, the $SiO_2$ film 102 as the thermal storage layer and as the interlayer insulation film was formed on the whole surface in thickness of 0.4 to 1.0 μm by the sputtering method. Alternately this $SiO_2$ film can be formed by the CVD method.

Figure 4F:
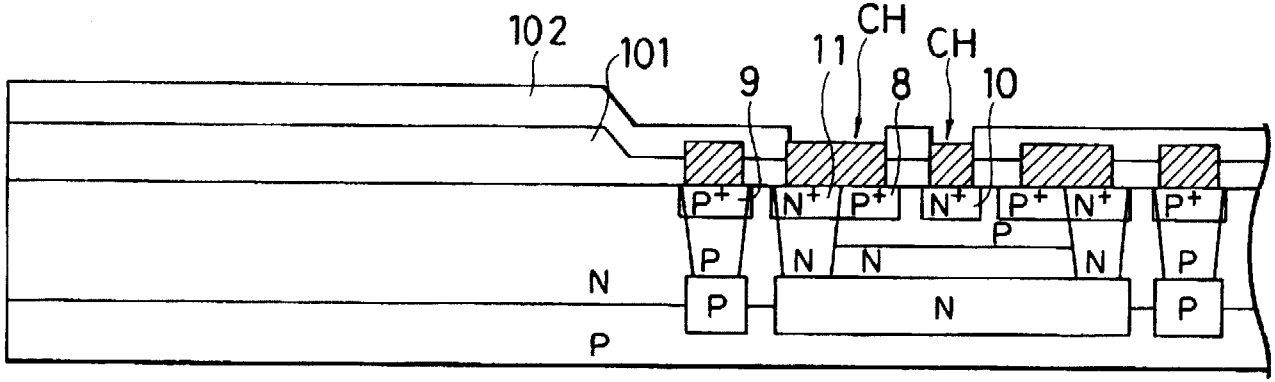

Next, openings were opened in a part CH of the insulation film 102 at the upper part of the emitter region and the base-collector region for electrical connection by photolithography (FIG. 4F).

Figure 4G:
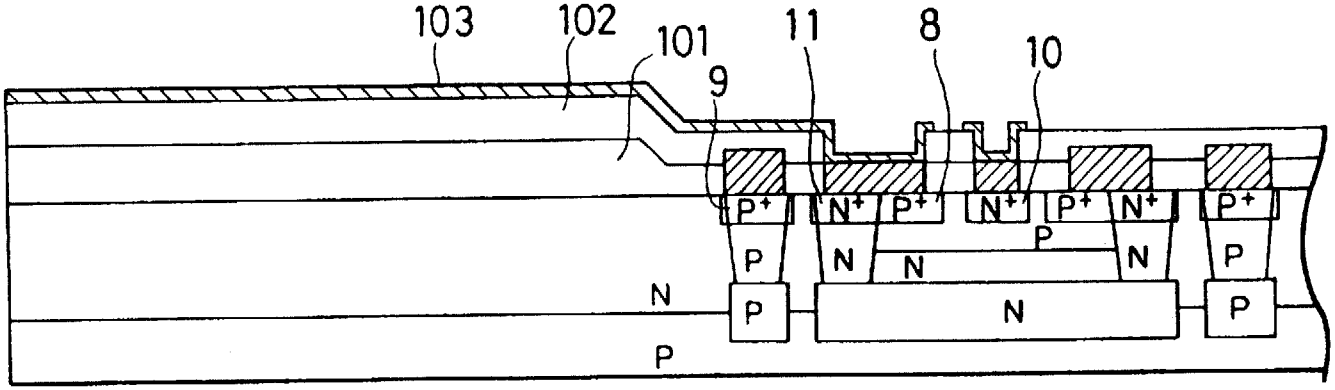

(7) Next, $HfB_2$ as the heat generating resistor layer 103 was deposited on the $SiO_2$ film 102 and on the electrode of the upper part of the emitter region and on the electrode of the upper part of the base-collector region for electrical connections in the thickness of about 1,000 Å, then, the $HfB_2$ film was patterned (FIG. 4G).

Figure 4H:
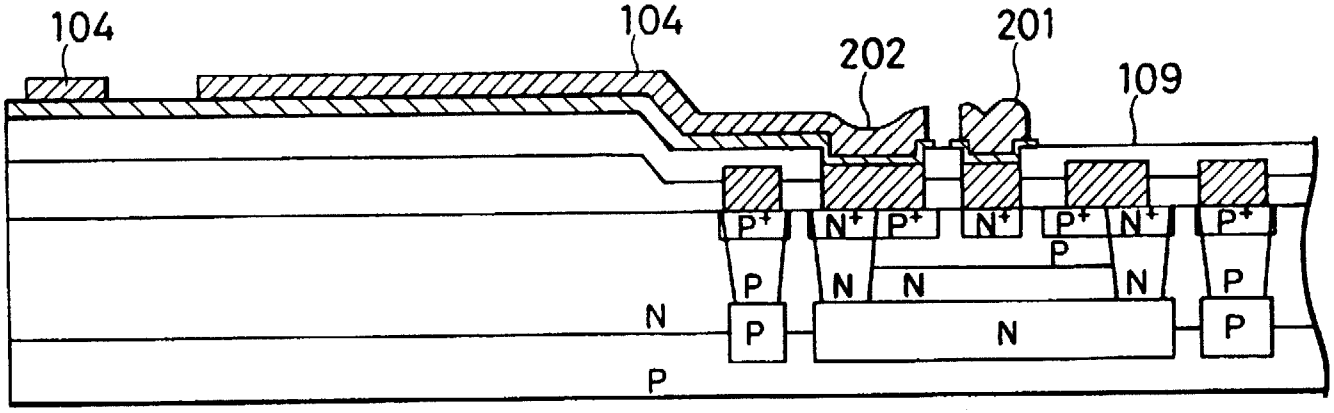

(8) A layer of A1 or A alloy was deposited on it for forming a pair of electrodes 104 of the electrothermal transducer and the anode electrode wiring 201 and cathode electrode wiring 202 of the diode, and was patterned to form wiring for the electrothermal transducer and other wiring at the same time (FIG. 4H).

Herein, it was preferable that a layer of Ti was formed between the heat generating resistor layer 103 and lower Al electrodes 12, 13 and 14 and/or between the heat generating resistor layer 103 and upper Al electrodes 104, 201 and 202 to increase coherence between the $HfB_2$ and Al. For forming the Ti layer between the resistor layer 103 and the lower electrodes, after forming the through holes for the lower Al electrodes, the Ti layer was deposited by the sputtering method of about 30 to 40 Å thickness. After depositing the $HfB_2$ layer on the Ti layer the upper layers 201 and 202 of Al were deposited on $HfB_2$ layer, and the Al layer was patterned by wet etching. Thereafter, Ti and $HfB_2$ layers were patterned by dry etching.

Figure 4I:
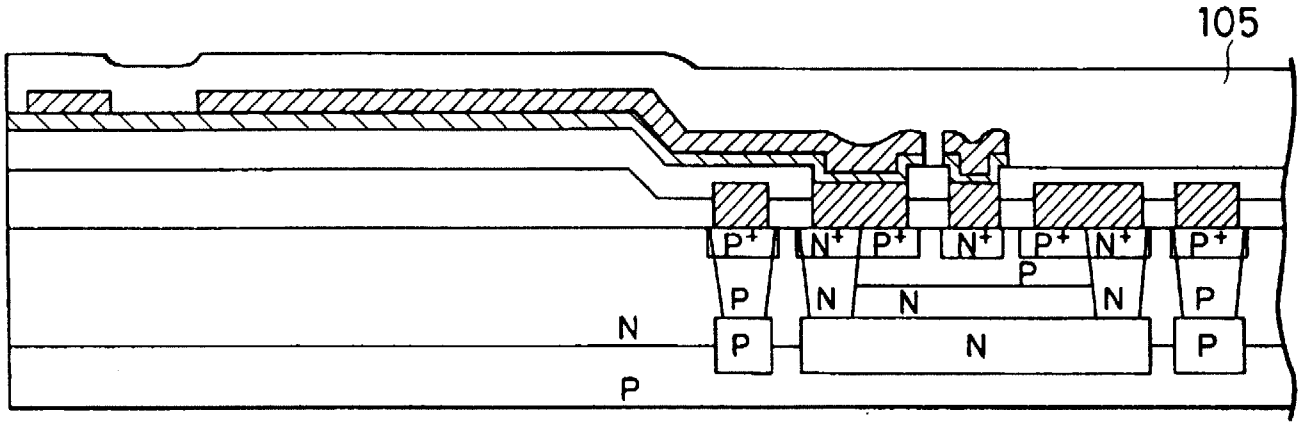

(9) Afterwards, the $SiO_2$ layer 105 was deposited as protection layer of the electrothermal transducer by the sputtering method (FIG. 4I).

Figure 4J:
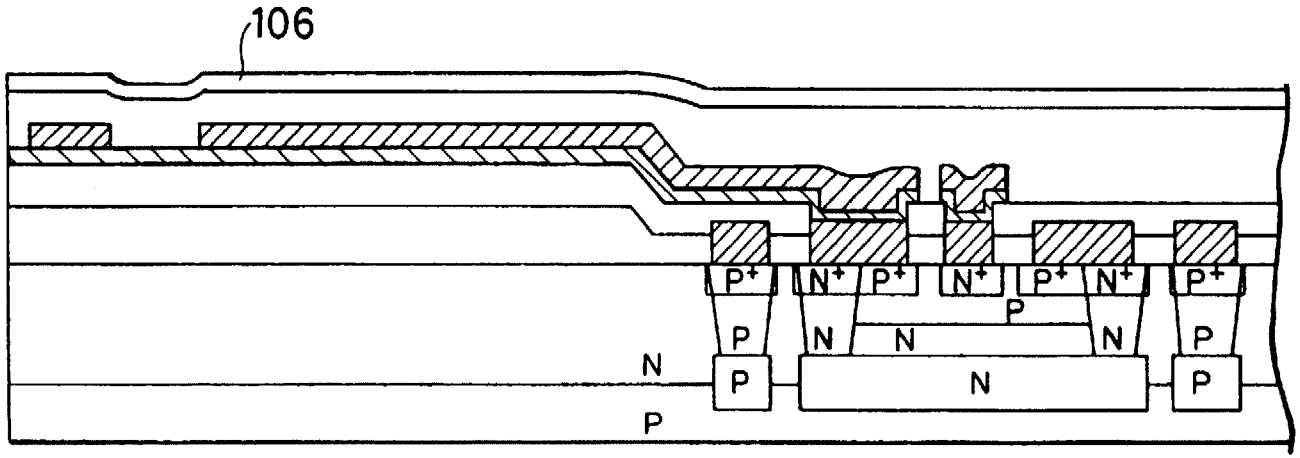

(10) Then, Ta was deposited on the upper part of the heat generating part of the electrothermal transducer in thickness of about 2,000 Å to form the protection layer 106 against cavitation (FIG. 4J).

Figure 4K:
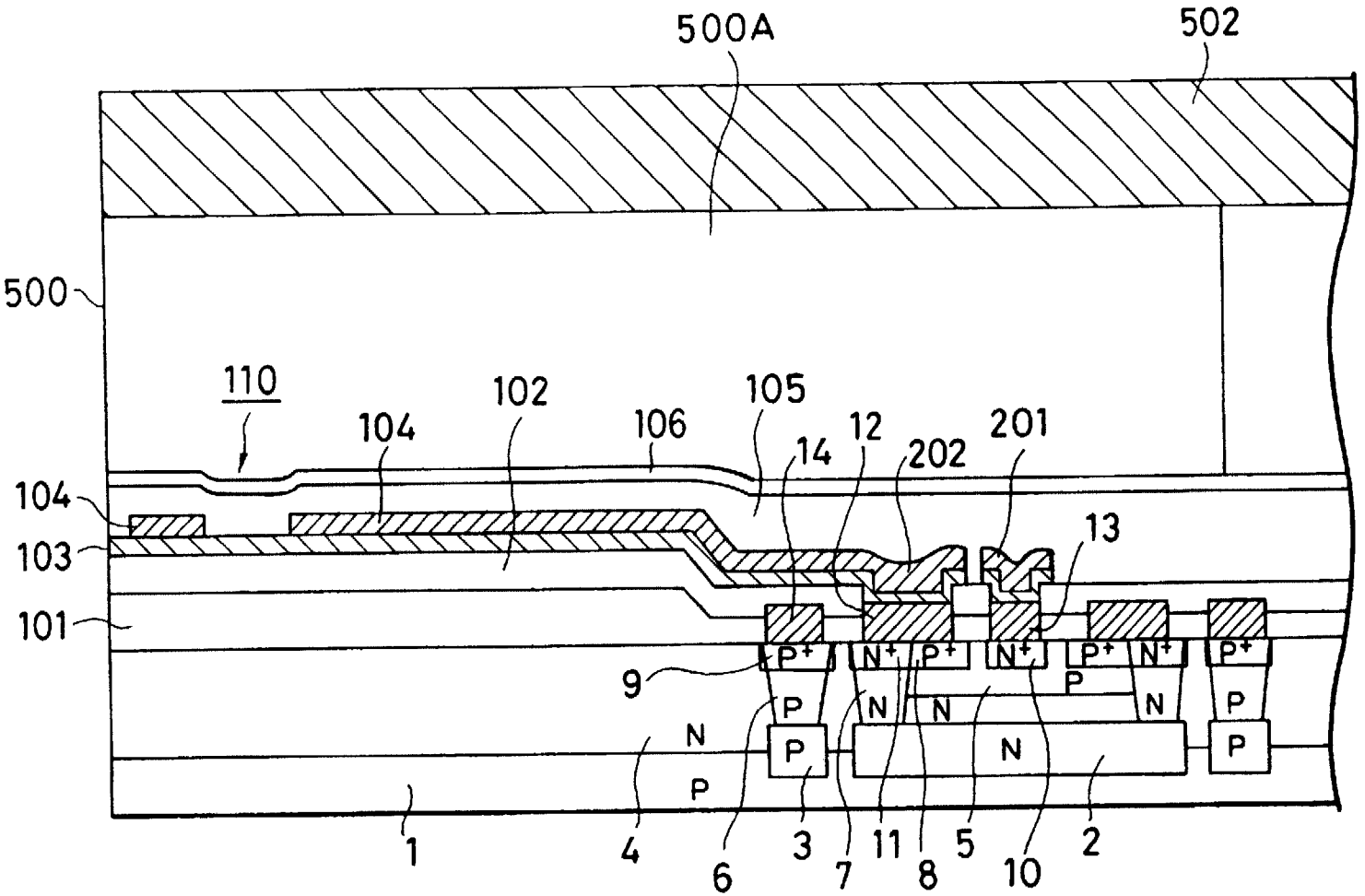

(11) On the substrate having the electrothermal transducers and the semiconductor devices manufactured in the above manner, a separation wall and a top plate 502 were disposed to define a liquid passage 500A connected to an ink ejecting outlet 500, thereby, a recording head was formed (FIG. 4K).

Operation and recording tests with respect to such recording heads were carried by block driving the electrothermal transducers. For the operation test, eight semiconductor diodes are connected in each one of the segments, and current of 300 mA (2.4 A in total) were flowed through respective ones of them. The rest of the semiconductor diodes did not malfunction and preferable ejection could be performed.

Next, the explanation will be given about the diodes in reserve relating to the main part of the present embodiment. Since the diodes in reserve of transistor construction shown in FIG. 3C are not yet in use, Al electrode for output and Al wirings 201 and 202 for the anode and the cathode are not yet provided. Therefore, the surface of the diodes are covered by the thermal storage layer 102, and optional disposition of the wiring is capable on the thermal storage layer 102.

In the case that there is caused necessity of using the diodes in reserve due to the design change on the circuit, those diodes in reserve come to be usable or operable by applying processes following the step (5) previously described.

Furthermore, in this embodiment, the structure of the diodes in reserve are explained as processed until the diffusion structure are formed, but, it can be defined as processed until earlier step, for example until forming the epitaxial layer by epitaxial growth, therefore, it is enough that those diodes are manufactured until the step at which the best efficiency can be shown in the process.

Figure 5A:
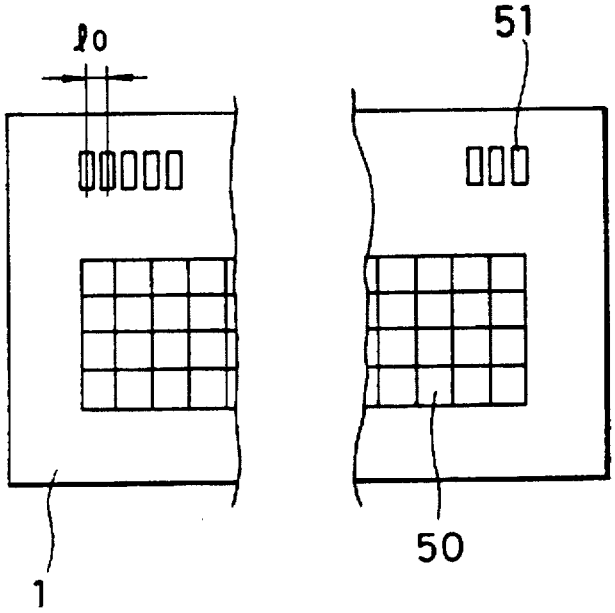
FIGS. 5A and 5B are a schematic top plan view of another embodiment of a substrate for use in a recording head according to the present invention and a schematic sectional view thereof, respectively.
Figure 5B:
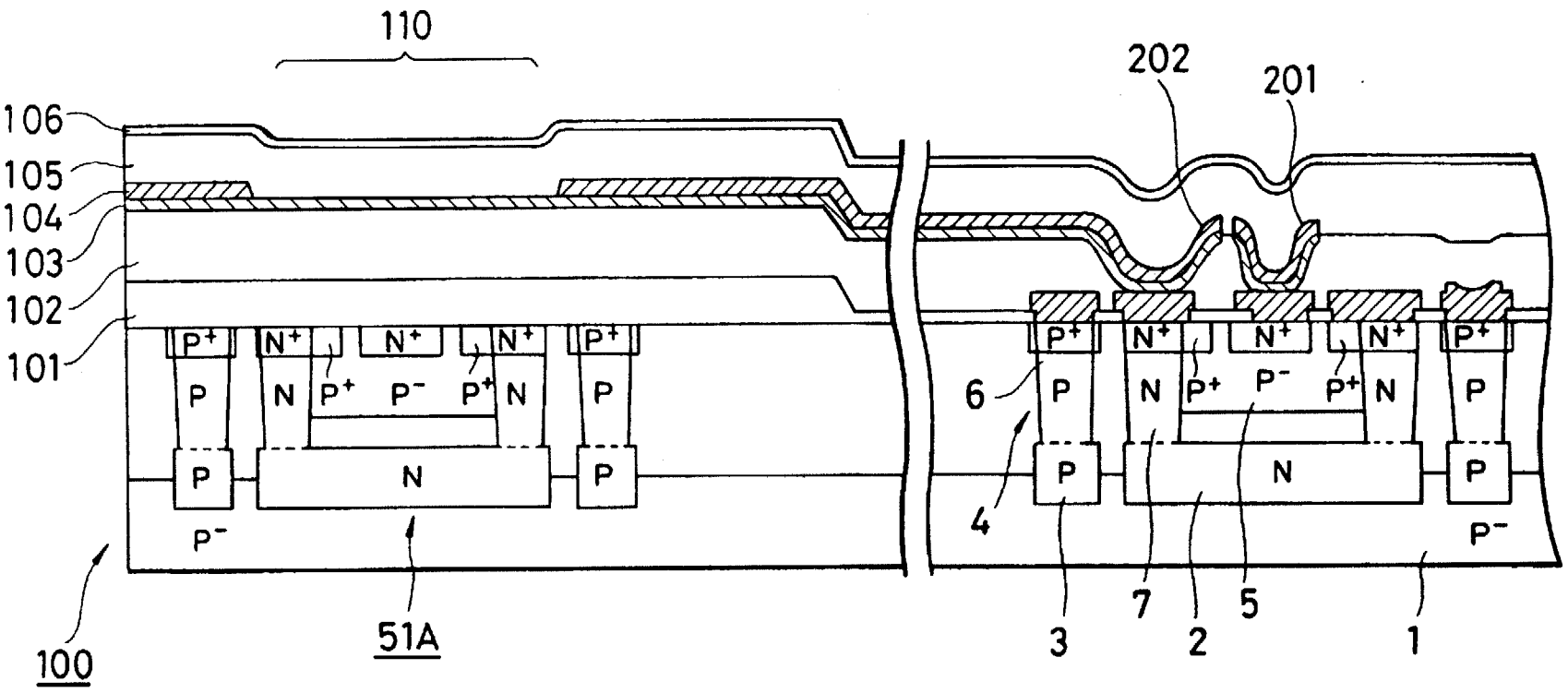

FIG. 5A is a schematic plan view showing another embodiment of a substrate for an ink jet recording head according to the present invention. In the present embodiment, the temperature sensor 51 is disposed just under a heater 110 at the same pitch lo of the heater in vertical alignment. FIG. 5B is a schematic cross sectional view of the silicon substrate of the present embodiment. Here is shown the condition that the heater 110 is provided on the device in reserve 51A. In this case, necessary electrodes and wiring are formed on the device 51A, and the heater 110 is formed after forming the temperature sensor, actually.

Figure 5C:
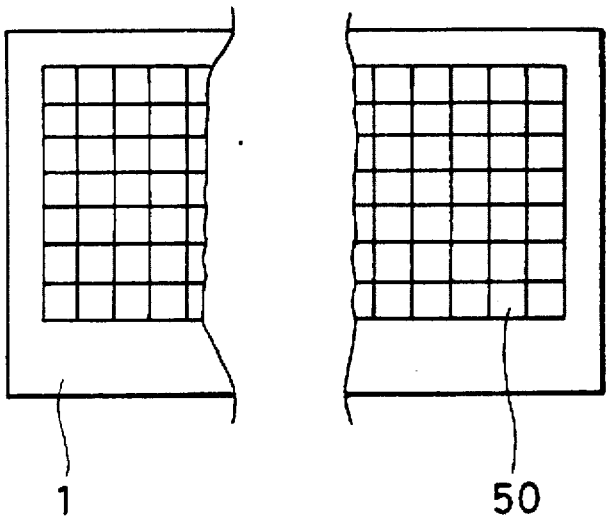
FIG. 5C is a schematic top plan view of a further embodiment of a substrate for use in a recording head according to the present invention.

FIG. 5C is a schematic plan view showing a further embodiment of a substrate for an ink jet recording head according to the present invention. In the present embodiment, diodes 50 are uniformly disposed on the silicon substrate. Therefore, freedom of changing the design is increased by disposing the diodes all over the whole surface of the substrate.

Figure 6A:
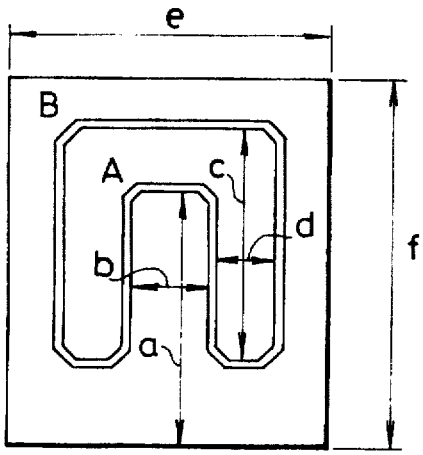
FIG. 6A is a schematic plan view showing the shape of the electrode of the functional device in an embodiment of a substrate according to the present invention.

For the above functional construction, the shape of the electrodes of the semiconductor device as the functional device can be determined as shown in FIG. 6A in the case of such as diode array.

Here, A portion is for example an anode electrode, B portion a cathode electrode. Respective shapes of the anode portion and cathode portion are more limited due to the previously mentioned restrictions peculiar to the ink jet head than normal semiconductor device, i.e. restrictions of (1) distance between the electrothermal transducers, (2) trouble due to the effect of the heat, and (3) mode of use.

With the trouble due to heat, it can be solved by such disposition that the semiconductor devices for drive are separated from the heat generating resistor as shown for example in FIG. 4K or FIG. 5B, and with the mode of use, it can be solved by such circuit construction as shown in FIG. 2B or FIG. 2C. The distance between the electrothermal transducers gives effect to the disposition of the semiconductor devices and the shape of the electrodes. Therefore, such construction as shown FIG. 6A is adopted in the present embodiment. The concrete sizes e and f are determined by the sizes of the electrothermal transducer and the heater board.

Figure 6C:
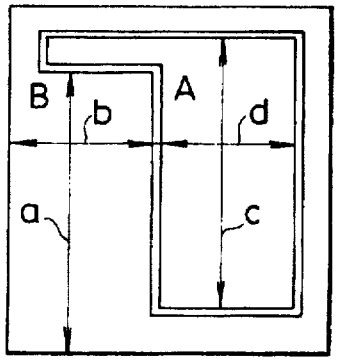
FIGS. 6C and 6D are schematic plan views showing other examples of shapes of the electrodes, respectively.
Figure 6B:
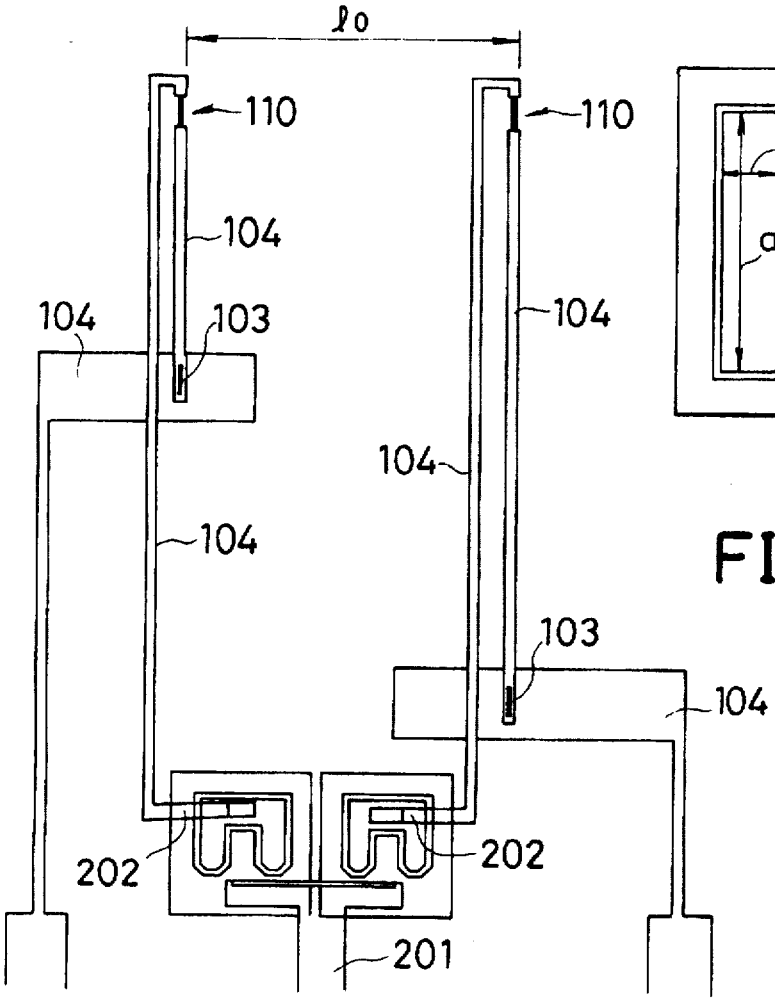
FIG. 6B is a schematic plan view showing an example of arrangement of the electrothermal transducer and the functional device.

Alignment of the devices can be two lines per block as shown in FIG. 6B for example. However, if the number of electrothermal transducers per block is increased, of course, it is satisfactory that the number of the functional devices is increased in accordance therewith. However, from view point of effective use of the elements, the value near about that presented by the following equation was appropriate.

$$f=(1\sim1.5)\times e$$

It is preferable that the electrodes within the devices have a shape as shown in FIG. 6A for enabling probing without the drawing electrodes even in the pre-condition previous to the completion of wiring. Namely, assuming, for example, a, b, c and d are width of enabling contact by probe pin, if a and d are 40 μm and b and c 80 μm, it is possible to carry probing sufficiently.

Figure 6D:
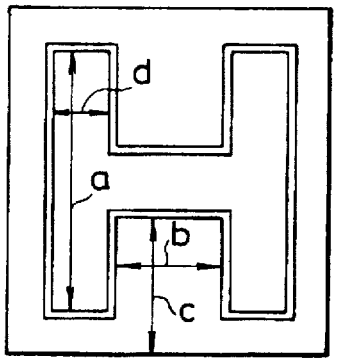

Of course, probing is possible with other shapes of the electrodes, such as shown in FIG. 6C and FIG. 6D. However, the disposition of the devices and the shape of the electrodes shown in FIG. 6A are appropriate, since the border line (shown as double lines in FIGS. 6A–6C) between the anode A and the cathode B is relatively short in FIG. 6C the forward voltage drop is large, and then it causes relatively disadvantageous effect for the characteristics of the semiconductor device with the electrodes shown in FIG. 6C, and since the width d of probing is narrow and the device must be enlarged as the result of this with the electrodes shown in FIG. 6A.

Further, the semiconductor device (functional device) may be a transistor array or a diode array, and the present invention can be applied effectively when drawing out the wiring from the anode and the cathode thereof.

The shape of the electrodes can be applied to all the necessary devices irrespective of the fact that the devices in reserve are formed or not.

As is explained above, according to the present invention, it enables not only to accept design change made another day in mass production for the substrate but also to avoid waste of the parts and so on by disposing the functional devices in reserve on the substrate beforehand irrespective of use or no use thereof. And, in the stage of the development, changing of the function can be performed easily only by changing the steps after the drawing out of wiring, thereby improving the efficiency of the development.

Moreover, in accordance with the present invention, it is not necessary to prepare various wafers in which various functional devices corresponding to the respective use are built-in. On the contrary, it is satisfactory that only one kind of wafer is provided with devices in reserve is prepared and windings fitting with various ways of use are provided in the process later corresponding to the necessity. Hence, the present invention is effective from the view point of the common use of parts.

Furthermore, with the recording head according to the present invention, since the semiconductor devices used therein have improved shape of electrode, measurement of the characteristics of the semiconductor devices on the way of production process of the head can be possible, thereby increasing the production yield of the head, furthermore abolishing the excessive monitoring and increasing accuracy in the measurement. According to the present invention, by determining the disposition of the semiconductor devices as the functional device and the shape of the electrodes in the recording head, miniaturization of the ink jet recording head and so on can be achieved as well as reduction of production cost thereof.

The following is one embodiment of a system installing the recording head of the present invention.

FIG. 7 through FIG. 11 illustrate each of an ink jet unit IJU, an ink jet head IJH, an ink tank IT, an ink jet cartridge IJC, an ink jet recording apparatus IJRA and a carriage HC and their relationships with which the recording head with its structure described above is embodied suitably. In the following descriptions, each component structure of the ink jet recording apparatus is explained with these drawings.

Figure 7:
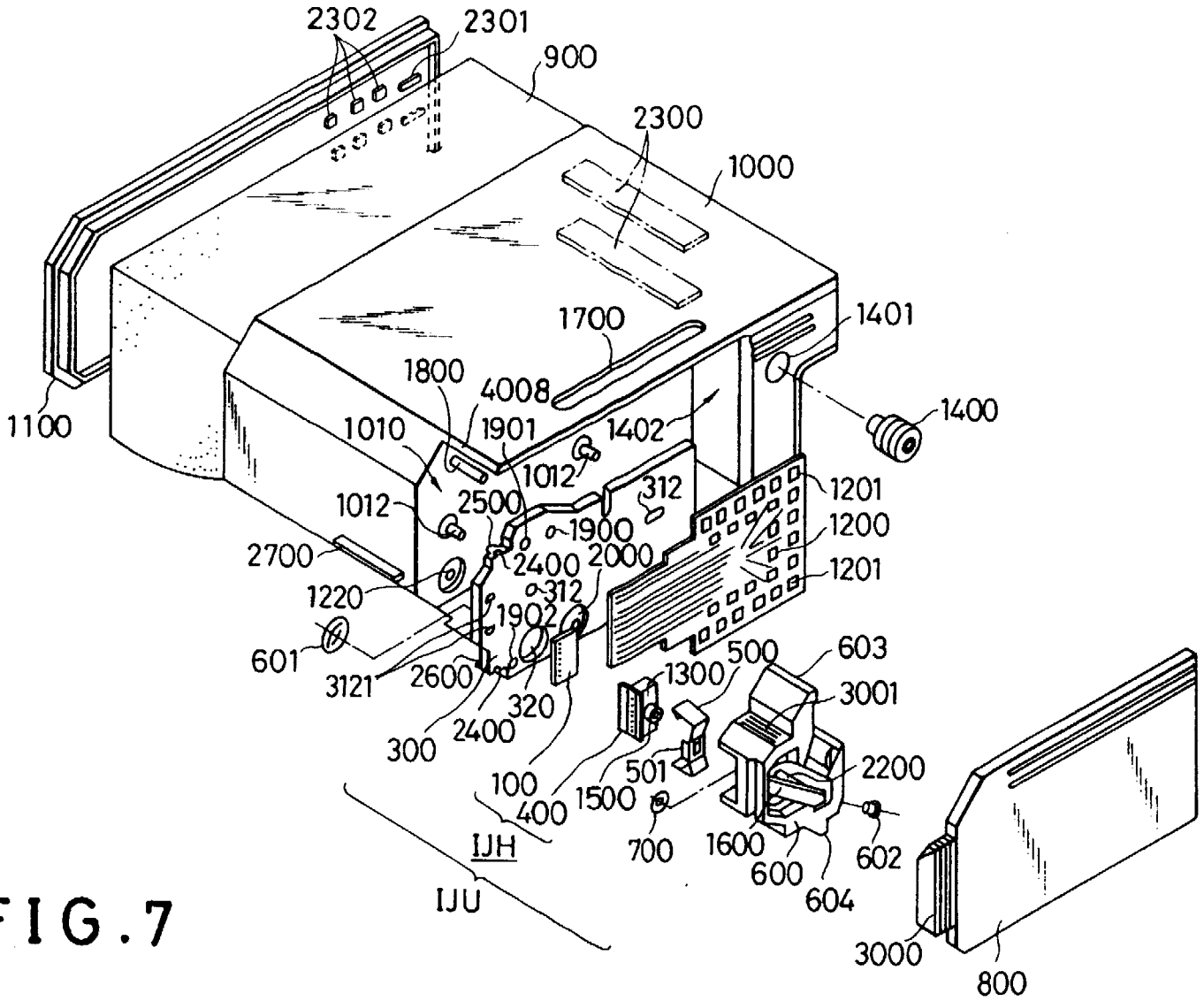
FIG. 7 is an exploded view of an ink jet cartridge of an ink jet recording apparatus using a recording head according to the present invention.
Figure 8:
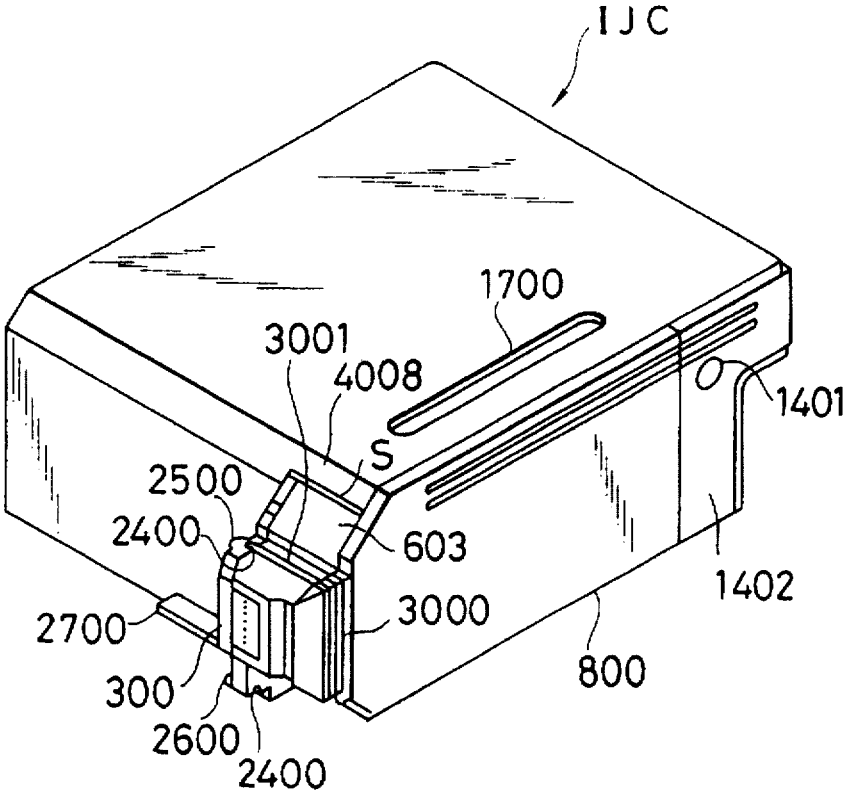
FIG. 8 is a perspective view of the ink jet recording apparatus fabricated with its components illustrated in FIG. 7.

The ink jet cartridge IJK in this embodiment, as being apparent in FIG. 8, has a large capacity for receiving ink and has such a shape that a portion of an ink jet unit IJU sticks out from the front face of the ink jet tank IT. This ink jet cartridge IJC is fixed and supported by the locating means and electric contacts, the details of which will be described later, above the carriage HC as shown in FIG. 10 which is mounted in the ink jet recording apparatus IJRA. In addition, this ink jet cartridge is a disposable type cartridge which means that the cartridge is detachable from the carriage HC. In FIG. 7 through FIG. 11, some inventions arisen in the progress of establishing this invention may be found in the structures of each components. Along with brief descriptions of these structures of each components, the overall picture of the ink jet recording apparatus IJRA is disclosed below.

(i) Description of the construction of the ink jet unit IJU

The ink jet unit IJU in this embodiment is a recording unit using an ink ejection mechanism which records information in terms of characters and visual images, using electrothermal transducers generating thermal energy to make film boiling take place in the ink in accordance with the application of electric signals.

In FIG. 7, a component 100 is a heater board and is composed of electrothermal transducers (ejection heaters) arranged in an array geometry on the silicon substrate and electric wiring supplying powers to the transducers based on a film forming technology. A component 1200 is a distribution substrate connecting to the heater board 100, containing wirings to the heater board 100 (both ends of the wirings, for example, are fixed by wire bonding) and pads 1201 locating at one end of the wiring from the heater board and making terminals of wires transferring electric signals from the host instrument of the recording apparatus.

A component 1300 is a top plate with gutters which has separation walls for defining individual ink passage and a common fluid reservoir. The top plate is a molded unit with an ink inlet 1500 for pouring ink supplied from the ink tank IT into the common fluid reservoir and an orifice plate 400. Though the preferable material for the molded unit is polysulfone, another kind of molding resin is acceptable to be used.

A component 300 is a support member, for example, made of metal, supporting the reverse side of the distributing substrate 1200 by meeting their flat faces together, forming the bottom of the ink jet unit IJU. A component 500 is a rebound spring shaped in a letter M. The rebound spring 500 holds the fluid reservoir by pressing it at the center of the letter M and at the same time its apron portion 501 also press a portion of ink passage. The heater board 100 and the top plate 1300 are held by the rebound spring 500 with its legs penetrated through holes 3121 on the support member 300 and fixed in the reverse side of the support member 300.

That is to say, the heater board 100 and the top plate 1300 are fixed and contacted to each other by the rebound force generated with the rebound spring 500 and its apron portion 501. The support member 300 has locating holes 312, 1900 and 2000 into which two protruding portions 1012 for locating on the side wall of the ink tank IT and protruding portions 1800 and 1801 for locating and supporting by fusion are inserted. Further, the support member 300 has also protruding portions 2500 and 2600 for locating the carriage HC in the ink jet recording apparatus IJRA in the bottom side of the support member 300. In addition, the support member 300 has a hole 320 through which ink supply pipe 2200, which makes the ink supply possible from the ink tank IT, a detailed description will be disclosed later, can penetrate through the side wall. The distributing substrate 1200 is bound on the support member 300 by bonding materials. There are a couple of concave portions 2400 of the support member 300 in the neighborhood of the protruding portions for locating 2500 and 2600. The concave portions 2400 are also located on the extension of the line from the apex portion of the head, three sides of which are defined by portions with a plurality of parallel gutters 3000 and 3001, in the ink jet cartridge IJC as shown in FIG. 8. This configuration of the support member 300 with portions 2400, 2500 and 2600 makes it possible to keep unfavorable dust and ink sludge away from the protruding portions 2500 and 2600. On the other hand, as illustrated in FIG. 7, a cover plate 800 with parallel gutters 3000 forms outer walls of the ink jet cartridge IJC as well as forms a space for the ink jet unit IJU. In an ink supply member 600 having another parallel gutter 3001 includes an ink pipe 1600 formed as a cantilever with its end fixed at the side of the ink supply pipe 2200 and linking continuously to the ink supply pipe 2200, and further a sealing pin 602 is inserted in order to establish a capillary action between the fixed end of the ink pipe 1600 and the ink supply pipe 2200. A component 601 is a packing material for bonding the ink tank IT and the ink supply pipe 2200 and sealing the gap between them and a component 700 is a filter placed at the side end part of the ink supply pipe 2200 connecting to the ink tank IT.

As the ink supply member 600 is made by a mold fabricating method, a low cost is attained and the component is finished with correct dimensions in a fabricating process practically. Further, owing to the cantilever structure of the ink supply member 600, it is possible to keep the stable state of pressing and bonding the ink pipe 1600 onto the ink inlet 1500 in mass production planning. In this embodiment, under the state of pressing and bonding the ink pipe 1600 onto the ink inlet 1500, only by pouring a sealing bond into the side of the ink inlet 1500 from the side to the ink supply member 600, it is possible to establish a perfect ink flow path without leakage. The method to fix the ink supply member 600 to the support member 300 is described as in the following steps; (1) to put pins (not shown) at the bottom side of the ink supply member 600 into holes 1901 and 1902 on the support member 300 and push out the pins from holes at the other face of the support member 300, and (2) to make the end portion of the pins pushed out from the hole fuse to be bonded on the other face of the support member 300. The end portion of the pins after heat processed described above occupies a relevant concave portion (not shown in drawings) on the surface of the ink tank IT when the ink jet unit IJU mounted and then a location of the ink jet unit IJU is fixed correctly with the ink tank IT.

(ii) Description of the structure of the ink tank IT

The ink tank IT is composed of a body of cartridge 1000, an ink absorber 900 and a cover plate 1100. The cover plate 1100 is used as to be a seal panel after inserting the ink absorber 900 into the body of cartridge 1000 from the opposite face to the face where the ink jet unit IJU is mounted in the body of cartridge 1000.

The ink absorber 900 is used for absorbing ink and placed in the body of cartridge 1000. A reference numeral 1220 denotes an ink supply inlet for supplying ink to the ink jet unit IJU comprising before mentioned components 100 through 600. In addition, the inlet 1220 is also used as to be an inlet port for pouring ink into the absorber 900 by pouring ink into the absorber 900 prior to mounting the ink jet unit IJU at the portion 1010 of the body of cartridge 1000.

In this embodiment, ink can be supplied into the ink tank IT through the both of an atmospheric air communication port 1401 and this ink supply inlet 1220. For the purpose of supplying ink into the absorber 900 relatively efficiently and uniformly, it is preferable to supply ink through the ink supply inlet 1220. This is because the empty space only containing air in the ink tank IT, which is formed by ribs 2300 and partial ribs 2301 and 2302 of the cover plate 1100 in order to attain an efficient ink supply flow from the absorber 900, occupies the corner space communicating with the atmospheric air communication port 1401 and positioning at a longest distant from the ink supply inlet 1220. This feature is very effective in view of practical use. The rib 2300 comprises four members parallel to the moving line of the carriage HC which members are formed at the back end face of the body 1000 of the ink tank and the rib 2300 prevents the absorber 900 from contacting to the back end face of the body 1000 of the ink tank. The partial ribs 2301 and 2302 are also placed on the inner surface of the cover plate 1100 positioned on the extension line from the rib 2300. In contrast with the rib 2300, the partial ribs 2301 and 2302 are composed of smaller pieces of ribs. Owing to this structure of the partial ribs 2301 and 2302, the volume of empty space containing air becomes larger. The partial ribs 2301 and 2302 are distributed over half or less of the area of the inner face of the cover plate 1100. With these ribs, the flow of ink in the absorber 900 at the corners of the ink tank IT far from the ink supply inlet 1220 being stabilized, that is, ink can be lead from every region of the absorber 900 into the neighboring region of the ink supply inlet 1220 by a capillary action. The atmospheric air communication port 1401 is an open hole on the cover plate 1402 for communicating air between the inner containment of the ink tank IT and the atmosphere. The atmospheric air communication port 1401 is plugged with a repellency material 1400 for preventing ink leakage.

The shape of the ink containment of the ink tank IT in this embodiment is a rectangular parallelopiped and a longer side of the shape is corresponding to the side of the ink tank IT. Hence, the layout of ribs described above is effective specifically in this case. In case that the ink tank IT has its longer side in the direction of the movement of the carriage HC or the ink tank IT has the inner containment shaped in a cube, the flow of ink in the absorber 900 can be stabilized by placing ribs on the whole area of the inner face of the cover plate 1100.

Figure 9:
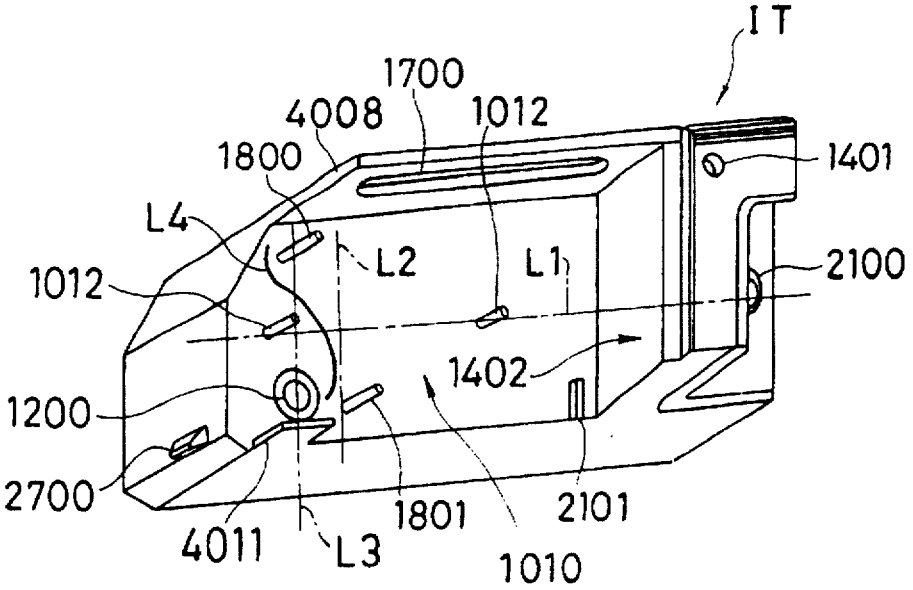
FIG. 9 is a perspective view of the mount portion of the ink jet unit illustrated in FIG. 7.
Figure 10:
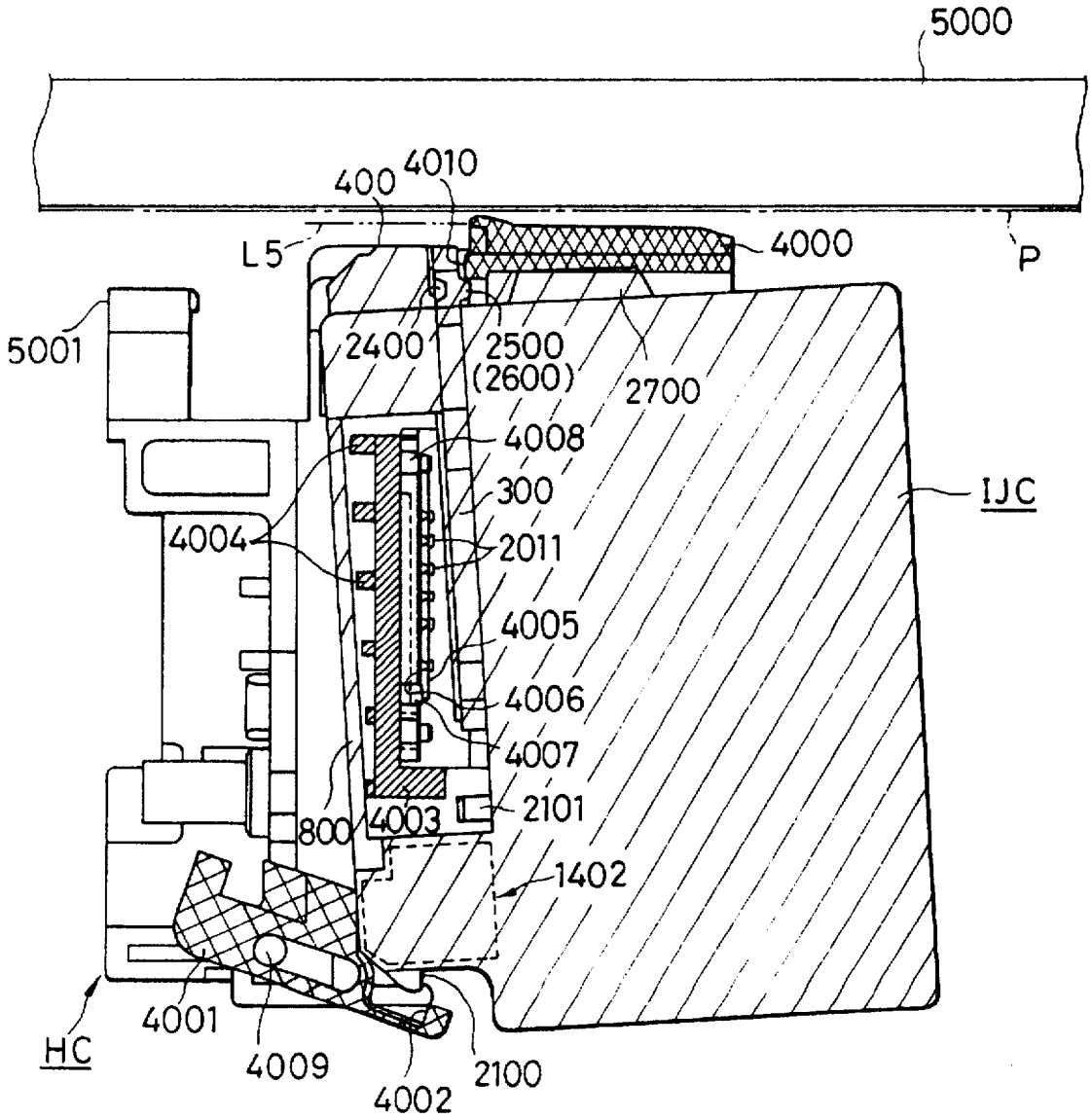
FIG. 10 is a top plan view illustrating the installed state of the ink jet cartridge of the ink jet recording apparatus shown in FIG. 7.

A structure of the fitting face of the ink tank IT to the ink jet unit IJU is illustrated in the FIG. 9. When a line L1 is taken to be a straight line passing through the center of the ink outlet port of the orifice plate 400 and parallel to the bottom face of the ink tank IT or to the reference face on the surface of the carriage along which the ink jet cartridge is mounted on the carriage HC, two protruding portions 1012 to be inserted into the hole 312 on the support member 300 are on the line L1. The height of the protruding portions 1012 is a little less than the thickness of the support member 300 and with the protruding portions 1012 the support member 300 is positioned. On the extension of the line L1, as shown in FIG. 9, a click 2100 is formed for catching a right angular hook surface 4002 of a locating hook 4001 (FIG. 10), so that a force for locating the carriage HC is applied on the surface region parallel to the before mentioned reference face on the surface of the carriage HC including the line L1. This layout relationship of the ink jet cartridge IJC, the locating hook 4001, the hook surface 4002, the click 2100 and the carriage HC forms an effective structure to make the accuracy of locating the ink tank IT alone equivalent to that of locating the ink outlet port of the ink jet head IJH.

In addition, the protruding portions 1800 and 1801, to be inserted in the holes 1900 and 2000 for fixing the support member 300 onto the side wall of the ink tank IT, have a length greater than that of the above mentioned protruding portions 1012 and are used for fixing the supporting member on the side wall of the ink tank IT. The protruding portions 1800 and 1801 are penetrated through the holes on the support member 300 and melted the end part of the protruding portions 1800 and 1801 and bonded on the surface of the support member 300. Let L3 a straight line intersecting perpendicularly with the straight line L1 and passing the protruding 1800, and let L2 a straight line intersecting perpendicularly with the straight line L1 and passing the protruding 1801. Because the center of the before mentioned ink supply inlet 1220 is locating nearly on the straight line L3, the protruding portion 1800 works for stabilizing the connection state between the ink supply inlet 1220 and the ink supply pipe 2200 so as to make it possible to reduce the over load on the connection state between the ink supply inlet 1220 and the pipe 2200 in case of dropping them and/or giving them shocks. As the straight lines L2 and L3 do not intersect at any point and there are protruding portions 1800 and 1801 in the neighborhood of the protruding portion 1012 at the side of the ink outlet port of the ink jet head IJH, the ink tank IT being supported on three points, supportive effect occurs for locating the ink jet head IJH on the ink tank IT. And a curve L4 in FIG. 9 shows the shape of the ink supply member when installed. As the protruding portions 1800 and 1801 are layed out along the curve L4, it is possible to provide the ink tank IT with high strength and dimensional accuracy under the application of the weight load of the top of the ink jet head IJH. A nose flange 2700 of the ink tank IT is inserted into the hole in a front plate 4000 of the carriage HC so as to prevent an abnormal state where the displacement of the ink tank IT becomes extremely large. Latchble portion 2101 inserted into yet another portion of the carriage HC for locating the ink tank IT in the carriage HC is formed in the ink tank IT.

The ink jet unit IJU being installed inside of the ink tank IT with the cover plate 800 closed afterward, the ink tank IT takes a shape of a box containing the ink jet unit IJU with its bottom open. The open face at the bottom of the ink tank IT bellow the ink jet unit IJU is closed when the ink jet cartridge IJC is mounted on the carriage HC, and hence a closed space is formed inside the ink jet cartridge IJC for containing the ink jet unit IJU. Accordingly, though the heat generated from the ink jet head IJH is valid as forming a heat jacket within the closed space in the ink jet unit IJU, during a long period of time of a continuous use of the ink jet head, the temperature of the closed space increases slightly. In this embodiment, for promoting a heat removal by a natural heat convection from the supporting member 300, a slit 1700 with a width less than that of the shorter side of the closed space formed inside of the ink jet cartridge IJC is formed on the upper deck of the ink jet cartridge IJC. Owing to the slit 1700, it is possible to prevent the temperature of the air within the closed space for accommodating the ink jet unit IJU in the ink jet cartridge IJC from increasing extremely and to establish an uniform temperature distribution in the whole space of the ink jet unit IJU being independent of any effect given by an environmental fluctuation.

When the ink jet cartridge IJC composed of the ink tank IT and the ink jet unit IJU is assembled as shown in FIG. 8, ink can be fed into the ink supply member 600 through the cartridge and thorough an ink inlet 1200, a hole 320 of the supporting member 300 and inlet provided at a back face of the ink supply member 600, and after ink flows inside the ink supply member 600, ink pours into a common fluid reservoir through an adequate ink supply tube and the ink inlet 1500 of the top plate 1300 from the ink outlet of the ink supply member 600. Gaps formed at connecting portions of components described above are filled with packing substance such as silicone rubber and butyl rubber for sealing gaps, and then the leakage-free ink feed route is established.

In this embodiment, a material used for the top plate 1300 is a synthetic resin such as polysulfone, polyether sulphone, polyphenylene oxide and polypropylene and the top plate 1300 is molded into a single module together with an orifice plate 400.

As described above, as the component for ejecting ink is integrated by formed of the ink supply member 600, the single module of the top plate 1300 and the orifice plate 400, and the body 1000 of the ink tank, not only the high accuracy in assembling the components can be attained but also a quality of components at a mass production planning is increased effectively. In addition, by assembling individual parts into a single molded component, the number of parts and components can be reduced, compared with a conventional way of assembling components, which leads to reflecting favorable and expected features of each component onto the resultant system.

(iii) Description of an installation of the ink jet cartridge IJC onto the carriage HC In FIG. 10, a component 5000 is a platen roller for guiding a sheet of paper as a recording medium P moving it in the direction from its lower side to its upper side. The carriage HC moves along a platen roller 5000. The carriage HC has, at the forward region of the carriage HC facing to the platen roller 5000, a front plate 4000 (with a thickness of 2 mm) in front of the ink jet carriage IJC, a flexible sheet 4005 furnished with pads 2011 corresponding to pads 1201 on the distributing substrate 1200 of the ink jet cartridge IJC, a support board 4003 for electrical connection, which holds a rubber pad 4006 for generating elastic force for pressing the reverse side of the flexible sheet 4005 onto the pads 2011, and the locating hook 4001 for holding the ink jet cartridge IJC on the right position of the carriage HC. The front plate 4000 has a locating protruding surface 4010 corresponding to the before mentioned locating protrusions 2500 and 2600 of the support member 300. The locating protruding surface 4010 receive a force from the ink jet cartridge IJC installed in the carriage HC by contacting to locating protrusions 2500 and 2600. The front plate 4000 has a plurality of ribs spanning in the direction along which the above mentioned force is received by the locating protruding surface 4010. The surface of these ribs is a little closer by about 0.1 mm to the platen roller 5000 than the position of surface (L5 in FIG. 10) of the ink jet head IJH and hence these ribs is used for protectors of the ink jet head IJH. The support board 4003 for electrical connection has a plurality of reinforcing ribs 4004 spanning in the vertical direction of the ink jet cartridge IJC in contrast to the spanning direction of the above mentioned ribs for the front plate 4000, and the protrusion to the side is gradually reduced along the direction from the platen side to the hook 4001. This configuration also enables the ink jet cartridge to be positioned with an inclination angle to the platen roller 5000. The support board 4003 for electrical connection has a locating surface 4007 on the side of the locating hook 4001 and a locating surface 4008 on the side of the platen roller 5000 to form a pad contact region between these locating surfaces and to limit the distortion length of a rubber pad sheet 4006 corresponding to pad 2011. Once the ink jet cartridge IJC is fixed in the right position for recording, the locating surfaces 4007 and 4008 contact on the surface of the distributing substrate 1200. Moreover, in this embodiment, as the pads 1201 are arranged on the distributing substrate 1200 so that their distribution may be symmetrical with respect to the before mentioned straight line L1, the distortion amount of the pads on the rubber pad sheet 4006 is made to be uniform and then a contacting force between the pads 2011 and 1201 is more stabilized. In this embodiment, the pads 1201 are arranged in an array with 2 rows and 2 columns.

The locating hook 4001 has a long hole linking an fixing axis 4009. Using a moving action of the fixing axis 4009 in the long hole in the location hook 4001, by rotating the locating hook 4001 counterclockwise from the position shown in the FIG. 10 and moving the locating hook 4001 left in the direction of the axis of the platen roller 500, the location of the ink jet cartridge can be fixed relative to the carriage HC. Though a moving action of the locating hook 4001 may be realized by any means, a preferable way is to move the locating hook with levers. The following is a further detailed and stepwise description about fixing the ink jet cartridge IJC into the carriage HC. (1) At first, in response to the rotating movement of the locating hook 4001, the ink jet cartridge IJC moves to the side of the platen roller 5000 and at the same time the locating protrusions 2500 and 2600 move to the position where they can contact the locating protruding surface 4010 of the front plate 4000. (2) Next, by the movement of the locating hook 4001 in the left direction, the hook surface 4002 catches the click 2100 and at the same time the locating hook 4001 rotates around the contacting of the locating components 2500 and 4010, and then as a result the pads 1201 and 2011 contacts closely to each other. (3) The locating hook 4001 catching the click 2100 being held in a fixed position with the fixed axis 4009, established are a perfect contacting state between the pads 1201 and 2011, a prefect contacting state between the locating protrusions 2500 and 4010, a perfect facial contacting state between the hook surface 4002 and the click 2100 and a perfect contacting state between the distributing substrate 1200 and the locating surfaces 4007 and 4008 of the support board 4003 for electrical connection at the same time, and then the fixing of the ink jet cartridge into the carriage HC is established finally.

(iv) Summarized description of a body of the ink jet recording apparatus

Figure 11:
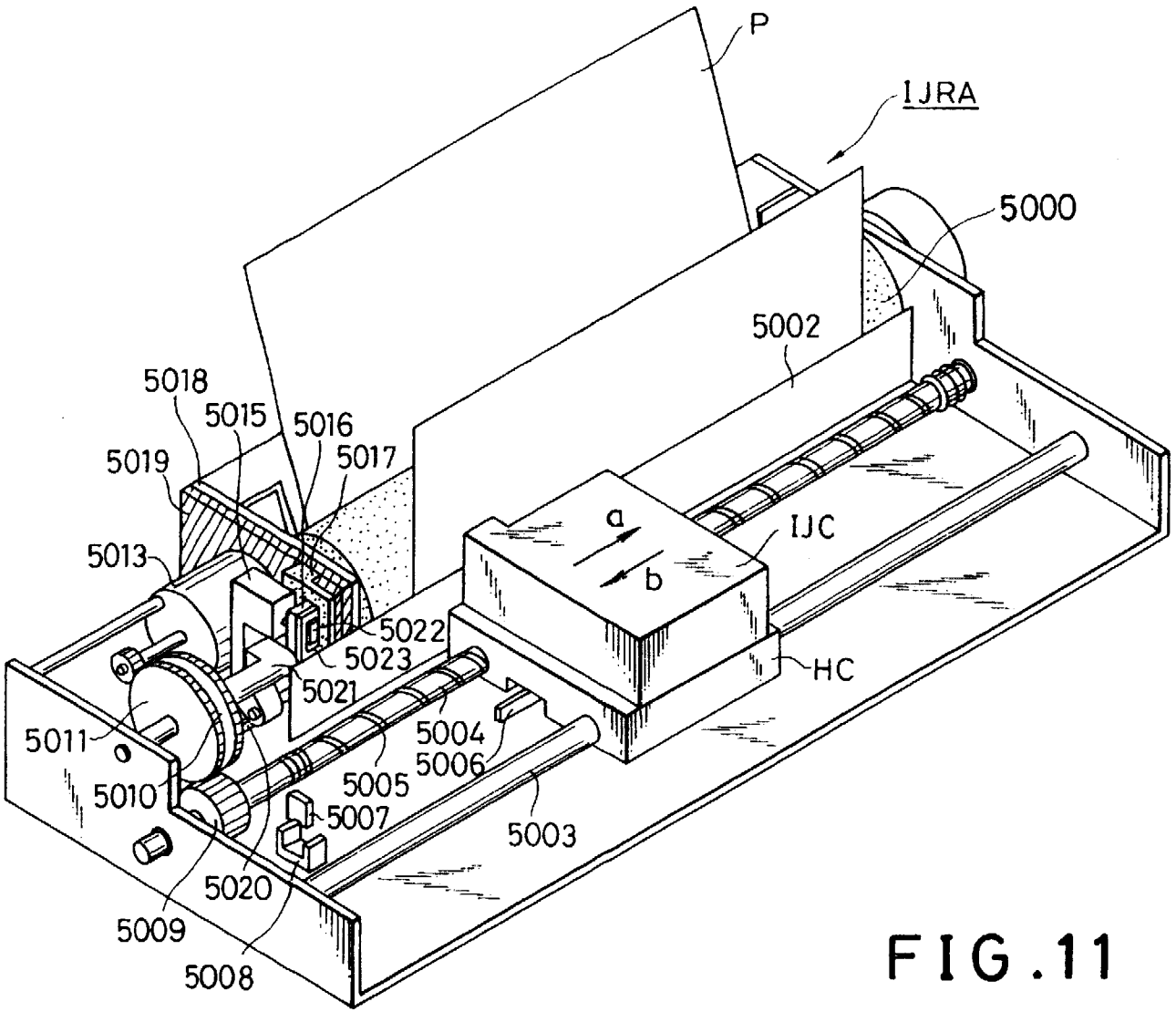
FIG. 11 is a perspective view of the ink jet recording apparatus equipped with the ink jet cartridge illustrated in FIG. 7.

FIG. 11 illustrates visually a summary of the ink jet recording apparatus IJRA to which ink jet head according to the present invention is applicable. The carriage HC is held by a lead screw axis 5004 with its screw channel 5005 catching a pin formed in a body of the carriage HC and the lead screw axis 5004 rotates by the torque transmitted through driving gears 5011, 5010 and 5009 from a driving motor 5013. As the driving motor 5013 rotates clockwise or counterclockwise, simultaneously the lead screw axis 5004 rotates in the same manner. The carriage HC moves in the either direction of a or b as shown in FIG. 11 as the lead screw axis 5004 rotates clockwise or counterclockwise. A component 5002 is a paper keep plate for press a paper sheet as a recording medium against the platen roller 5000 along the moving direction of the carriage HC. Components 5007 and 5008 are photo-couplers, which generate a signal to indicate that the carriage HC is in a specific position like a home position by sensing an existence of a lever 5006 in the region where photo-couplers are placed. A component 5016 is a supporting member for support a cap member 5022 caping the front side of the ink jet head IJH. A component 5015 is an absorption means for absorbing ink inside the cap member 5022 from an aperture 5023 of the cap member 5022 so as to restore and increase the ink outlet power of the ink jet head IJH. A component 5017 is a cleaning blade. A component 5019 is a member for enabling the cleaning blade 5017 to move forward or backward and supported by a body supporting plate 5018. As for another embodiment of the cleaning blade 5017, it is no need to say that another type of cleaning blades as used in prior art is applicable to the present embodiment. In addition, a lever 5021 used for starting to restore an absorbing ability moves in accordance with the movement of a cam 5020 catching the carriage HC and this movement is controlled by a torque transmission means as used in prior art such as means for switching a clutch by a driving force from the driving motor 5013. In order to perform capping, cleaning and absorption restoration operations, components mentioned above and a controller for actuating them are formed so that expanded tasks regarding the above mentioned operations may be performed at an appropriate sequence and at their right positions controlled by the rotation of the screw channel 5005 when the carriage HC arrives at its home position mentioned above.

(v) Various Aspects of the Invention

The present invention is particularly suitably useable in an ink jet recording head having heating elements that produce thermal energy as energy used for ink ejection and recording apparatus using the head. This is because, the high density of the picture elements, and the high resolution of the recording are possible.

The typical structure and the operational principle if preferably those disclosed in U.S. Pat. Nos. 4,723,129 and 4,740,796. The principle is applicable to a so-called on-demand type recording system and a continuous type recording system. Particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Application Laying-open No. 123670/1984 wherein a common slit is used as the ejection outlet for plurality electrothermal transducers, and to the structure disclosed in Japanese Patent Application Laying-open No. 138461/1984 wherein an opening for absorbing pressure waves of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plurality of recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or suction means, preliminary heating means by the ejection electrothermal transducer or by a combination of the ejection electrothermal transducer and additional heating element and means for preliminary ejection not for the recording operation, which can stabilize the recording operation.

As regards the kinds and the number of the recording heads mounted, a single head corresponding to a single color ink may be equipped, or a plurality of heads corresponding respectively to a plurality of ink materials having different recording colors or densities may be equipped. The present invention is effectively applicable to an apparatus having at least one of a monochromatic mode solely with a main color such as black and a multi-color mode with different color ink materials or a full-color mode by color mixture. The multi-color or full-color mode may be realized by a single recording head unit having a plurality of heads formed integrally or by a combination of a plurality of recording heads.

Furthermore, in the foregoing embodiment, the ink has been liquid. It may, however, be an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is unused is effective to prevent the evaporation of the ink. In either of the cases, with the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material in through holes or recesses formed in a porous sheet as disclosed in Japanese Patent Application Laying-open No. 56847/1979 and Japanese Patent Application Laying-open No. 71260/1985. The sheet is faced to the electrothermal transducers. The most effective one for the ink materials described above is the film boiling system.

The ink jet recording apparatus may be used as an output means of various types of information processing apparatuses such as a work station, personal or host computer, a word processor, a copying apparatus combined with an image reader, a facsimile machine having functions for transmitting and receiving information, or an optical disc apparatus for recording and/or reproducing information into and/or from an optical disc. These apparatuses require means for outputting processed information in the form of hard copy.

Figure 12:
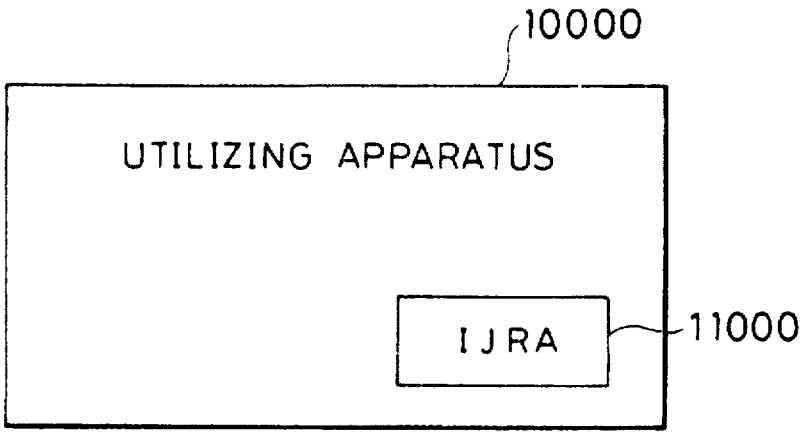
FIG. 12 is a schematic diagram illustrating an embodiment of an apparatus in accordance with the present invention to which the ink jet recording system shown in FIG. 11 is equipped.

FIG. 12 schematically illustrates one embodiment of a utilizing apparatus in accordance with the present invention to which the ink jet recording system shown in FIG. 11 is equipped as an output means for outputting processed information.

In FIG. 12, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 11. The ink jet recording apparatus (IJRA) 11000 receives processed information form the utilizing apparatus 10000 and provides a print output as hard copy under the control of the utilizing apparatus 10000.

Figure 13:
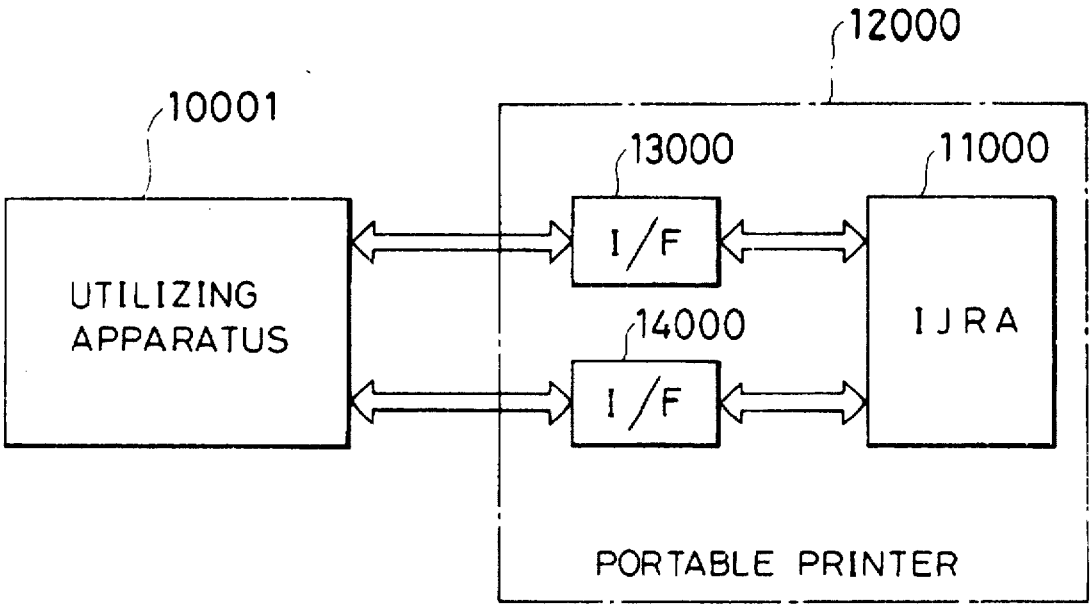
FIG. 13 is a schematic drawing illustrating an embodiment of a portable printer in accordance with the present invention.

FIG. 13 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 13, reference numeral 10001 schematically denotes such a utilizing apparatus. Reference numeral 12000 schematically denotes a portable printer having the ink jet recording apparatus (IJRA) 11000 shown in FIG. 11 is incorporated thereinto and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

Although specific embodiments of a record apparatus constructed in accordance with the present invention have been disclosed, it is not intended that the invention be restricted to either the specific configurations or the uses disclosed herein. Modifications may be made in a manner obvious to those skilled in the art.

For example, although the embodiments are described with regard to a serial printer, the present invention can also be applied to line printers. Here, the serial printer is defined as a printer that has a moving member on which the record head is mounted, the moving member being moved to and from in the direction perpendicular to the transporting direction of the recording paper. Accordingly, it is intended that the invention be limited only by the scope of the appended claims.

What is claimed is:

1. An ink jet recording head comprising:

an ink discharging portion having an outlet for discharging ink; and a substrate on which are provided at least one electrothermal transducer for generating thermal energy utilized for discharging ink supplied to said ink discharging portion, and a plurality of functional devices associated therewith, said functional devices being provided in a number greater than a number of said electrothermal transducers, so that a fraction of said functional devices are used, and a remaining fraction of said functional devices are reserve functional devices, wherein each said functional device has electrodes provided directly above said functional device, and wherein each of said functional devices which are used is electrically connected to an associated said electrothermal transducer and the electrodes of each said reserve functional device which is unused are disposed below an associated said electrothermal transducer.

2. A substrate for an ink jet recording head comprising:

at least one electrothermal transducer for generating thermal energy to be utilized for discharging ink; and a plurality of functional devices associated therewith, said functional devices being provided in a number greater than a number of said electrothermal transducers, so that a fraction of said functional devices are used, and a remaining fraction of said functional devices are reserve functional devices, wherein each said functional device has electrodes provided directly above said functional device, and wherein each of said functional devices which are used is electrically connected to an associated said electrothermal transducer and the electrodes of each said reserve functional device which is unused are disposed below an associated said electrothermal transducer.

3. An ink jet recording apparatus comprising:

a recording head including an ink discharging portion having an outlet for discharging ink and a substrate on which are provided at least one electrothermal transducer for generating thermal energy utilized for discharging ink supplied to said ink discharging portion, and a plurality of functional devices associated therewith, said functional devices being provided in a number greater than a number of said electrothermal transducers, so that a fraction of said functional devices are used, and a remaining fraction of said functional devices are reserve functional devices, wherein each said functional device has electrodes provided directly above said functional device, and wherein each of said functional devices which are used is electrically connected to an associated said electrothermal transducer, and the electrodes of each said reserve functional device which is unused are disposed below an associated said electrothermal transducer;

means for supplying the ink to said recording head; and means for transmitting a recording medium to a recording position adjacent said recording head.

4. An information apparatus comprising:

an ink jet recording apparatus including:

a recording head including an ink discharging portion having an outlet for discharging ink and a substrate on which are provided at least one electrothermal transducer for generating thermal energy utilized for discharging ink supplied to said ink discharging portion, and a plurality of functional devices associated therewith, said functional devices being provided in a number greater than a number of said electrothermal transducers, so that a fraction of said functional devices are used, and a remaining fraction of said functional devices are reserve functional devices, wherein each said functional device has electrodes provided directly above said functional device, and wherein each of said functional devices which are used is electrically connected to an associated said electrothermal transducer, and the electrodes of each said reserve functional devices which is unused are disposed below an associated said electrothermal transducer;

means for supplying the ink to said recording head; and means for transmitting a recording medium to a recording position adjacent said recording head.

5. An information apparatus as claimed in claim 4, wherein said information apparatus is a facsimile machine and further comprises means for receiving signals from another facsimile machine, the signals being representative of information to be reproduced by said ink jet recording apparatus.

6. An information apparatus as claimed in claim 4, wherein said information apparatus is a word processor and further comprises keyboard means for inputting data to be recorded by said ink jet recording apparatus.

7. An information apparatus as claimed in claim 4, wherein said information apparatus is an optical disc apparatus and further comprises means for supporting an optical disc for storing information.

8. An information apparatus as claimed in claim 4, wherein said information apparatus is a work station and further comprises means for processing information to be output by said ink jet recording apparatus.

9. An information apparatus as claimed in claim 4, wherein said information apparatus is a computer and further comprises means for processing information to be output by said ink jet recording apparatus.

10. An information apparatus as claimed in claim 4, wherein said information apparatus is a portable printer and further comprises a compact housing for housing said ink jet recording apparatus.

* * * * *

UNITED STATES PATENT AND TRADEMARK OFFICE

CERTIFICATE OF CORRECTION

PATENT NO. : 5,726,696

DATED : March 10, 1998

INVENTOR(S) : ASAO SAITO ET AL.

It is certified that error appears in the above-identified patent and that said Letters Patent is hereby corrected as shown below:

COLUMN 1

Line 42, "head" should read --head,--; and
Line 43, "was developed, developed was an ink jet recording head" should read --an ink jet recording head was developed--.

COLUMN 2

Line 17, "were" should read --was--.

COLUMN 10

Line 20, "more" should read --in more--.

COLUMN 11

Line 40, "photorithography" should read --photolithography--.

COLUMN 14

Line 10, "is for example" should read --is, for example,--; and
Line 25, "FIG. 6A" should read --in FIG. 6A--.

COLUMN 17

Line 8, "steps;" should read --steps:--.

COLUMN 18

Line 54, "over load" should read --overload--.

UNITED STATES PATENT AND TRADEMARK OFFICE

CERTIFICATE OF CORRECTION

PATENT NO. : 5,726,696

DATED : March 10, 1998

INVENTOR(S) : ASAO SAITO ET AL.

It is certified that error appears in the above-identified patent and that said Letters Patent is hereby corrected as shown below:

COLUMN 19

Line 4, "Latchble" should read --Latchable--.

COLUMN 20

Line 19, "is" should read --are--;
Line 45, "an" should read --a--; and
Line 66, "contacts" should read --contact--.

COLUMN 22

Line 35, "because," should read --because--.

COLUMN 23

Line 55, "form" should read --from--.

Signed and Sealed this

First Day of December, 1998

*Attest:*

*Attesting Officer*

BRUCE LEHMAN

*Commissioner of Patents and Trademarks*